US008096349B2

(12) United States Patent
Considine et al.

(10) Patent No.: US 8,096,349 B2
(45) Date of Patent: Jan. 17, 2012

(54) APPARATUS FOR EXTRACTION OF HYDROCARBON FUELS OR CONTAMINANTS USING ELECTRICAL ENERGY AND CRITICAL FLUIDS

(75) Inventors: Brian C. Considine, Chelmsford, MA (US); John A. Cogliandro, Dedham, MA (US); Maureen P. Cogliandro, Dedham, MA (US); John M. Moses, Dedham, MA (US); John R. Hannon, Quincy, MA (US); John P. Markiewicz, Andover, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 359 days.

(21) Appl. No.: 11/314,880

(22) Filed: Dec. 20, 2005

(65) Prior Publication Data

US 2007/0137852 A1 Jun. 21, 2007

(51) Int. Cl.
*E21B 36/04* (2006.01)
*E21B 43/24* (2006.01)

(52) U.S. Cl. ..... 166/60; 166/57; 166/302

(58) Field of Classification Search ..... None
See application file for complete search history.

(56) References Cited

U.S. PATENT DOCUMENTS

| | | | | |
|---|---|---|---|---|
| 2,685,930 | A | | 8/1954 | Albaugh |
| 2,757,738 | A | | 8/1956 | Ritchey |
| 3,666,014 | A | | 5/1972 | Beard |
| 3,753,594 | A | | 8/1973 | Beard |
| 3,881,550 | A | | 5/1975 | Barry |
| 4,108,760 | A | | 8/1978 | Williams |
| 4,135,579 | A | | 1/1979 | Rowland et al. |
| 4,140,179 | A | * | 2/1979 | Kasevich et al. ..... 166/248 |
| 4,140,180 | A | | 2/1979 | Bridges et al. |
| 4,144,935 | A | | 3/1979 | Bridges et al. |
| 4,193,448 | A | | 3/1980 | Jeambey |
| 4,193,451 | A | | 3/1980 | Dauphine |
| 4,196,329 | A | | 4/1980 | Rowland et al. |
| 4,265,307 | A | | 5/1981 | Elkins |

(Continued)

FOREIGN PATENT DOCUMENTS

SU 672332 7/1979

OTHER PUBLICATIONS

Koel, et al., "Using Neoteric Solvents in Oil Shale Studies", Pure Appl. Chem., 2001, pp. 153-159; 73:1.

(Continued)

*Primary Examiner* — Angela M DiTrani
(74) *Attorney, Agent, or Firm* — Rachel E. Greene; Brigid Laffey

(57) ABSTRACT

The extraction of hydrocarbon fuel products such as kerogen oil and gas from a body of fixed fossil fuels such as oil shale is accomplished by applying a combination of electrical energy and critical fluids with reactants and/or catalysts down a borehole to initiate a reaction of reactants in the critical fluids with kerogen in the oil shale thereby raising the temperatures to cause kerogen oil and gas products to be extracted as a vapor, liquid or dissolved in the critical fluids. The hydrocarbon fuel products of kerogen oil or shale oil and hydrocarbon gas are removed to the ground surface by a product return line. An RF generator provides electromagnetic energy, and the critical fluids include a combination of carbon dioxide ($CO_2$), with reactants of nitrous oxide ($N_2O$) or oxygen ($O_2$).

24 Claims, 12 Drawing Sheets

U.S. PATENT DOCUMENTS

| | | | | |
|---|---|---|---|---|
| RE30,738 | E | 9/1981 | Bridges et al. | |
| 4,301,865 | A | 11/1981 | Kasevich et al. | |
| 4,320,801 | A | 3/1982 | Rowland et al. | |
| 4,363,717 | A | 12/1982 | Pelrine | |
| 4,373,581 | A | 2/1983 | Toellner | |
| 4,376,034 | A | 3/1983 | Wall | |
| 4,396,062 | A | 8/1983 | Iskander | |
| 4,401,162 | A * | 8/1983 | Osborne | 166/248 |
| 4,449,585 | A | 5/1984 | Bridges et al. | |
| 4,456,065 | A | 6/1984 | Heim et al. | |
| 4,457,365 | A | 7/1984 | Kasevich et al. | |
| 4,476,926 | A | 10/1984 | Bridges et al. | |
| 4,485,869 | A | 12/1984 | Sresty et al. | |
| 4,487,257 | A | 12/1984 | Dauphine | |
| 4,498,535 | A | 2/1985 | Bridges | |
| 4,508,168 | A | 4/1985 | Heeren | |
| 4,524,826 | A | 6/1985 | Savage | |
| 4,573,805 | A * | 3/1986 | Savage et al. | 374/136 |
| 4,576,231 | A | 3/1986 | Dowling et al. | |
| 4,583,589 | A * | 4/1986 | Kasevich | 166/60 |
| 4,700,716 | A | 10/1987 | Kasevich et al. | |
| 4,747,938 | A | 5/1988 | Khan | |
| 4,817,711 | A | 4/1989 | Jeambey | |
| 5,055,180 | A | 10/1991 | Klaila | |
| 5,065,819 | A | 11/1991 | Kasevich | |
| 5,190,405 | A | 3/1993 | Vinegar et al. | |
| 5,236,039 | A | 8/1993 | Edelstein et al. | |
| 5,829,519 | A | 11/1998 | Uthe | |
| 6,102,122 | A * | 8/2000 | de Rouffignac | 166/302 |
| 6,591,906 | B2 * | 7/2003 | Wellington et al. | 166/250.01 |
| 6,702,016 | B2 * | 3/2004 | de Rouffignac et al. | 166/245 |
| 7,091,460 | B2 | 8/2006 | Kinzer | |
| 7,109,457 | B2 | 9/2006 | Kinzer | |
| 7,115,847 | B2 | 10/2006 | Kinzer | |
| 2002/0173682 | A1 | 11/2002 | Di Tullio | |
| 2007/0108202 | A1 | 5/2007 | Kinzer | |
| 2007/0131591 | A1 | 6/2007 | Pringle | |

OTHER PUBLICATIONS

Triday, et al., "Dynamic Behavior of Supercritical Extraction of Kerogen from Shale", AIChE Journal, 1998, pp. 658-668; 34:4.

Willey, et al., "Reactivity Investigation of Mixtures of Propane and Nitrous Oxide", Process Safety Progress, 2005, pp. 303-309, 24;4, Wiley Interscience.

Advanced Resources Int'l, Inc. & Stimlab, Inc., "Treatment of Hydrocarbon Organic Residue and Production Chemical Damage Mechanisms Through the Application of Carbon Dioxide in Natural Gas Storage Wells, Final Report DE-FC26-99FT-40702, Oct. 1, 1999-Sep. 30, 2003."

Apak, E. et al., "Supercritical Fluid Extraction of Goynuk Oil Shale and Avgamasya Asphaitite Derived Pitches Using CO2", Istanbul Technical University, Istanbul, Turkey, pp. 490-491, circa 1993.

Bridges, J. E. et al., "Net Energy Recoveries for the in Situ Dielectric Heating of Oil Shale", Oil Shale Symposium Proceedings, 1978, Chicago, IL: 311-330.

Cleveland, Cutler J. et al., "Energy and the U.S. Economy: A Biophysical Perspective", Science, New Series, 225: 4665 (1984); 890-897.

Cleveland, Cutler J. et al., Aggregation and the role of energy in the economy, Ecological Economics, 32 (2000), 301-317.

Gallo, Yann Le et al., "Assessing the Risks of Geological Storage of CO2 in Mature Oil Fields", Institute Francais du Petrole, Rueil Malmaison, France; 1-5, circa 2002.

Hirasaki, George J. et al., "NMR properties of petroleum reservoir fluids", Magnetic Resonance Imaging, 21 (2003) 269-277.

Issler, Dale R. et al., "Petrophysical, geochemical and well log properties of Cretaceous shales of the Western Canada Sedimentary Basis—implications for basin analysis and hydrocarbon exploration", Geological Survey of Canada, Calgary, AB, pp. 1-4, circa 1999.

Jun, Yan et al., "Determining reservoir parameters from log and core date: a case study from the North Sea", Edinburgh University and British Geological Survey, Scotland, 1-4, circa 1995.

Krooss, Bernhard et al., "Assessment of the CO2, Sealing Efficiency of Pelitic Rocks: Two-Phase Flow and Diffusive Transport", 1-4, circa 2004.

Krooss, B. et al., "Experimental determination of diffusion parameters for light hydrocarbons in water-saturated rocks: Some selected results", Advances in Organic Geochemistry 1985, Org. Geochem. 10: (1986) 291-297.

Maddox, Mark, Statement Before the Committee on Energy and Natural Resources United States Senate, Oil Shale and Oil Sands Resources Hearing (2005), 1-4.

Odum, Howard T., "Energy Evaluation", Emergy Systems.Org., http://www.emergysystems.org/emergy.php; 1-11, May 30, 2005.

Okamoto, Ikuo et al., "Effect of supercritical CO2 as the organic solvent on cap rock sealing performance for underground storage", Energy 30 (2005), 2344-2351.

Porter, James H., "Investigation of the Extraction of Hydrocarbons from Shale Ore Using Supercritical Carbon Dioxide", Advanced Energy Projects, FY 1984 Research Summaries, 13 (Abstract).

Schlomer, S. et al., Experimental characterisation of the hydrocarbon sealing efficiency of cap rocks, Marine and Petroleum Geology, 14:5 (1997), 565-580.

Sinag, A., et al., "Comparison of Retorting and Supercritical Extraction Techniques on Gaining Liquid Products form Goynuk Oil Shale (Turkey)", Energy Sources (2004) 26: 739-749.

Thyne, Geoffrey, "A model for diagenetic mass transfer between adjacent sandstone and shale", Department of Geology and Geological Engineering, Colorado School of Mines, Golden, CO, 1-44, circa 1999.

Tucker, David J. et al., "A Comparison of Retorting and Supercritical Extraction Techniques of El-Lajjun Oil Shale", Energy Sources (2000) 22:453-463.

Upreti, Simant R. et al., "Diffusivity of CO2, CH4, C2H6 and N2 in Athabasca Bitumen", The Canadian Journal of Chemical Engineering (2002) 80:116 (Abstract).

Xu, Tianfu et al., "Mineral Sequestration of Carbon Dioxide in a Sandstone-Shale System", http://repositories.cdlib.org/lbnl/LBNL-55818; Berkeley, CA, (2004) 1-49.

* cited by examiner

APPARATUS FOR EXTRACTION OF HYDROCARBON FUELS OR CONTAMINANTS USING ELECTRICAL ENERGY AND CRITICAL FLUIDS

CROSS REFERENCE TO RELATED APPLICATIONS

This nonprovisional patent application is being filed concurrently with nonprovisional application Ser. No. 11,314,857 "METHOD FOR EXTRACTION OF HYDROCARBON FUELS OR CONTAMINANTS USING ELECTRICAL ENERGY AND CRITICAL FLUIDS",.

BACKGROUND OF THE INVENTION

1. Field of the Invention

This invention relates generally to extraction of hydrocarbon fuels from a body of fixed fossil fuels in subsurface formations such as oil shale, heavy oil in aging wells, coal, lignite, peat and tar sands, and in particular to a method and apparatus for extraction of kerogen oil and hydrocarbon gas from oil shale in situ utilizing electrical energy and critical fluids (CF), and extraction of contaminants or residue from a body of fixed earth or from a vessel in situ utilizing electrical energy and critical fluids (CF).

2. Description of Related Art

Oil shale, also known as organic rich marlstone, contains organic matter comprised mainly of an insoluble solid material called kerogen. Kerogen decomposes during pyrolysis into kerogen oil and hydrocarbon gasses, which can be used as fuels or further refined into other transportation fuels or products. Shale oil and hydrocarbon gas can be generated from kerogen by a pyrolysis process, i.e. a treatment that consists of heating oil shale to elevated temperatures, typically 300 to 500° C. Prior to pyrolysis, kerogen products at room temperature have substantial portions of high viscosity non-transformed material such that they cannot be accessed within the rock/sand matrix. The shale oil is then refined into usable marketable products. Early attempts to process bodies of oil shale in situ by heating the kerogen in the oil shale, for example, injecting super-heated steam, hot liquids or other materials into the oil shale formation, have not been economically viable even if fundamentally feasible (which some were not). Early and current attempts to process bodies of oil shale above ground to obtain the kerogen in the oil shale, for example, by mining, crushing and heating the shale in a retort type oven, have not been environmentally feasible nor economically viable.

It is well known to use critical fluids for enhanced oil and gas recovery by injecting naturally occurring carbon dioxide into existing reservoirs in order to maximize the output of oil and gas. By pumping carbon dioxide or air into the reservoirs, the existing oil or gas is displaced, and pushed up to levels where it is more easily extracted.

An article by M. Koel et al. entitled "Using Neoteric Solvents in Oil Shale Studies", Pure Applied Chemistry, Vol. 73, No. 1, PP 153-159, 2001 discloses that supercritical fluid extraction (SFE) at elevated temperatures with carbon dioxide modified with methanol or water can be used to extract kerogen from ground shale. This study was targeted at replacing analytical techniques using conventional solvents. Most of these solvents are not environmentally desirable and are impractical for use on a large scale.

In a paper by Treday, J. and Smith, J, JAIChE, Vol. 34, No. 4, pp 658-668, supercritical toluene is shown to be effective for the extraction of kerogen from shale. This study used oil shale which was mined, carried to above ground levels, and ground to ¼" diameter particles in preparation for the extraction. This labor intensive preparation process was to increase diffusivity, as the in-situ diffusivity reported would not support toluene's critical point of 320 degrees Celsius. "In-Situ" diffusivity of $5\times10^{-9}$ $M^2/s$ was estimated, resulting in a penetration of a few centimeters per day which was insufficient. Furthermore the cost of toluene and the potential environmental impact of using toluene in-situ were prohibitive. Finally, maintaining the temperature of 320 degrees Celsius would be expensive in a toluene system.

In a paper by Willey et. al, "Reactivity Investigation of Mixtures of Propane on Nitrous Oxide", scheduled for publication in December, 2005 in Process Safety Progress, the use of $CO_2$ to inhibit an oxidation reaction from becoming a hazardous runaway reaction is demonstrated. However in this article it is not contemplated to use such a reactant for in-situ fossil fuel processing, shale heating, etc.

Critical fluids are compounds at temperatures and pressures approaching or exceeding the thermodynamic critical point of the compounds. These fluids are characterized by properties between those of gasses and liquids, e.g. diffusivities are much greater than liquids, but not as great as gasses and viscosity is lower than typical liquid viscosities. Density of critical fluids is a strong function of pressure. Density can range from gas to liquid, while the corresponding solvent properties of a critical fluid also vary with temperature and pressure which can be used to advantage in certain circumstances and with certain methods. Critical fluids were first discovered as a laboratory curiosity in the 1870's and have found many commercial uses. Supercritical and critical $CO_2$ have been used for coffee decaffeination, wastewater cleanup and many other applications.

Many efforts have been attempted or proposed to heat large volumes of subsurface formations in situ using electric resistance, gas burner heating, steam injection and electromagnetic energy such as to obtain kerogen oil and gas from oil shale. Resistance type electrical elements have been positioned down a borehole via a power cable to heat the shale via conduction. Electromagnetic energy has been delivered via an antenna or microwave applicator. The antenna is positioned down a borehole via a coaxial cable or waveguide connecting it to a high-frequency power source on the surface. Shale heating is accomplished by radiation and dielectric absorption of the energy contained in the electromagnetic (EM) wave radiated by the antenna or applicator. This is superior to more common resistance heating which relies solely on conduction to transfer the heat. It is superior to steam heating which requires large amounts of water and energy present at the site.

U.S. Pat. No. 3,881,550 issued May 6, 1975 to Charles B. Barry and assigned to Ralph M. Parson Company, discloses a process for in situ recovery of hydrocarbons or heavy oil from tar sand formations by continuously injecting a hot solvent containing relatively large amounts of aromatics into the formations, and alternatively steam and solvents are cyclically and continuously injected into the formation to recover values by gravity drainage. The solvents are injected at a high temperature and consequently lie on top of the oil shale or tar sand and accordingly no complete mixing and dissolving of the heavy oil takes place.

U.S. Pat. No. 4,140,179 issued Feb. 20, 1979 to Raymond Kasevich, et al. and assigned to Raytheon Company discloses a system and method for producing subsurface heating of a formation comprising a plurality of groups of spaced RF energy radiators (dipole antennas) extending down boreholes to oil shale. The antenna elements must be matched to the electrical conditions of the surrounding formations. However, as the formation is heated, the electrical conditions can change whereby the dipole antenna elements may have to be removed and changed due to changes in temperature and content of organic material.

U.S. Pat. No. 4,508,168, issued Apr. 2, 1985 to Vernon L. Heeren and assigned to Raytheon Company, is incorporated herein by reference and describes an RF applicator positioned down a borehole supplied with electromagnetic energy through a coaxial transmission line whose outer conductor terminates in a choking structure comprising an enlarged coaxial stub extending back along the outer conductor. It is desirable that the frequency of an RF transmitter be variable to adjust for different impedances or different formations, and/or the output impedance of an impedance matching circuit be variable so that by means of a standing wave, the proper impedance is reflected through a relatively short transmission line stub and transmission line to the radiating RF applicator down in the formation. However, this approach by itself requires longer application of RF power and more variation in the power level with time. The injection of critical fluids (CF) will reduce the heating dependence, due solely on RF energy, simplifying the RF generation and monitoring equipment and reducing electrical energy consumed. The same is true if simpler electrical resistance heaters are used in place of the RF. Also, the injection of critical fluids (CF) as in the present invention increases the total output of the system, regardless of heat temperature or application method, due to its dilutent and carrier properties.

The process described in U.S. Pat. Nos. 4,140,179 and 4,508,168 and other methods using resistance heaters, require a significant amount of electric power to be generated at the surface to power the process and does not provide an active transport method for removing the products as they are formed and transporting them to the surface facilities. $CO_2$, or another critical fluid, which also acts as an active transport mechanism, can potentially be capped in the shale after the extraction is complete thereby reducing greenhouse gases released to the atmosphere.

U.S. Pat. No. 5,065,819 issued Nov. 19, 1991 to Raymond S. Kasevich and assigned to KAI Technologies discloses an electromagnetic apparatus for in situ heating and recovery of organic and inorganic materials of subsurface formations such as oil shale, tar sands, heavy oil or sulfur. A high power RF generator which operates at either continuous wave or in a pulsed mode, supplies electromagnetic energy over a coaxial transmission line to a downhole collinear array antenna. A coaxial liquid-dielectric impedance transformer located in the wellhead couples the antenna to the RF generator. However, this requires continuous application and monitoring of the RF power source and the in-ground radiating hardware, to provide the necessary heating required for reclamation.

SUMMARY OF THE INVENTION

Accordingly, it is therefore an object of this invention to provide a method and apparatus for extraction of hydrocarbon fuel from a body of fixed fossil fuels using electrical energy and critical fluids (CF).

It is another object of this invention to provide a method and apparatus for in situ extraction of kerogen from oil shale using a combination of RF energy and critical fluids.

It is a further object of this invention to provide a method and apparatus for effectively heating oil shale in situ using a combination of RF energy and a critical fluid.

It is a further object of this invention to provide a method and apparatus for effectively converting kerogen to useful production in-situ using RF energy and a critical fluid.

It is a further object of this invention to provide a method and apparatus for effectively obtaining gaseous and liquefied fuels from deep, otherwise uneconomic deposits of fixed fossil fuels using RF energy and critical fluids.

It is a further object of this invention to provide a method and apparatus for extraction of heavy oils from aging oil wells using electrical energy and critical fluids.

It is another object of this invention to provide a method and apparatus for extraction of hydrocarbon fuels, liquid and gaseous fuels, from coal, lignite, tar sands and peat using electrical energy or critical fluids.

It is a further object of this invention to provide a method and apparatus for remediation of oil and other hydrocarbon fuels from a spill site, land fill or other environmentally sensitive situation by using a combination of electrical energy and critical fluids and to recover liquid and gaseous fuels from same.

It is yet another object of this invention to provide a method and apparatus to remove material from any container with-out danger to an in-situ human, such as cleaning a large industrial tank of paint or oil sludge.

These and other subjects are further accomplished by a system for producing hydrocarbon fuels from a body of fixed fossil fuels beneath an overburden comprising means for transmitting electrical energy down a borehole to heat the body of fixed fossil fuels, means for providing a critical fluid down the borehole for diffusion into the body of fixed fossil fuels at a predetermined pressure, and means included with the critical fluid for initializing a reaction with the body of fixed fossil fuels to cause the hydrocarbon fuels to be released. The system comprises means for removing the hydrocarbon fuels from the borehole to a ground surface above the overburden. The system comprises means at the ground surface for separating the hydrocarbon fuel, gases, critical fluids, or contaminants. The means for transmitting electrical energy down a borehole comprises an RF generator coupled to a transmission line for transferring electrical energy to a RF Applicator. The means for providing critical fluids comprises means for providing carbon dioxide ($CO_2$). The means for initiating a reaction with the body of fixed fossil fuels comprises a reactant including nitrous oxide ($N_2O$) or Oxygen ($O_2$). The means for initiating a reaction with the body of fixed fossil fuels comprises a catalyst including one of nano-sized iron oxide ($Fe_2O_3$), silica aerogel, and nano-sized alumina ($AL_2O_3$) aerogel. The system comprises means, added to the critical fluid, for modifying the polarity and solvent characteristics of the critical fluid. The system comprises means for mixing critical fluids, reactants, catalysts or modifiers prior to entering the borehole. The system comprises a wellhead positioned on top of the borehole for receiving the critical fluid and the electrical energy and transferring the critical fluid and the electrical energy down the borehole. The wellhead comprises means for decoupling RF energy from thermocouple wires extending down the borehole.

The RF energy decoupling means comprises an RF choke connected to a filter capacitor for each thermocouple line. Also, the RF energy decoupling means comprises a hollow RF choke, the RF choke being formed by the thermocouple wires which are insulated and rotated to form a coil, each end of the thermocouple wires being connected to a filter capacitor. The wellhead comprises a grounding screen positioned adjacent to an outer surface of the wellhead forming a ground plane to eliminate electromagnetic radiation eminating from around the wellhead for operator safety and performance. The wellhead comprises a plurality of ground wires extending radially a distance of approximately one wavelength of the electrical energy frequency and spaced apart at predetermined intervals of approximately 15 degrees. The wellhead comprises a grounding screen positioned adjacent to an outer surface of the wellhead forming a ground plane, and a plurality of ground wires extending radially from the perimeter of the grounding screen at a distance of approximately one wavelength of the electrical energy frequency and spaced apart at predetermined intervals. The system comprises an auxiliary well spaced apart from the borehole and extending down to the body of fixed fossil fuels for extracting the released hydrocarbon fuels. The auxiliary well comprises an auxiliary wellhead, a well pipe extending downward from the wellhead, a pump coupled to the auxiliary wellhead for bringing fuel products up to a ground surface above the overburden, and a gas/liquid separator coupled to the auxiliary wellhead.

The objects are further accomplished by a system for producing hydrocarbon fuels from a body of fixed fossil fuels beneath an overburden comprising a plurality of boreholes each of the boreholes comprises means for transmitting electrical energy down each of the boreholes to heat the body of fixed fossil fuels, means for providing critical fluids down each of the boreholes for diffusion into the body of fixed fossil fuels at a predetermined pressure, means included with the critical fluids for initializing a reaction with the body of fixed fossil fuels to cause the hydrocarbon fuels to be released, and means for controlling the electrical energy and the critical fluids to each of the boreholes. The system comprises means for removing the hydrocarbon fuels from each of the boreholes to a ground surface above the overburden. The system comprises means at the ground surface for separating the hydrocarbon fuel, gases, critical fluids, or contaminants. The means for transmitting electrical energy down each of the boreholes comprises a central RF generator coupled to transmission lines for transferring electrical energy to a RF Applicator in each of the boreholes. The system comprises means for impedance matching outputs of the central RF generator to each of the RF applicators in each of the boreholes. The means for controlling the electrical energy to each of the boreholes comprises means for shifting sequentially RF power from the central RF generator to the RF applicator in each of the boreholes. The means for controlling the critical fluids to each of the boreholes generates control signals to control the critical fluids injected into each of the boreholes. The means for providing the critical fluids comprises means for providing carbon dioxide ($CO_2$). The means included with the critical fluids for initiating a reaction with the body of fixed fossil fuels comprises a reactant including nitrous oxide ($N_2O$) or Oxygen ($O_2$). The means included with the critical fluids for initiating a reaction with the body of fixed fossil fuels comprises a catalyst including one of nano-sized iron oxide ($Fe_2O_3$), silica aerogel, and nano-sized alumina ($AL_2O_3$) aerogel. The system comprises means, added to the critical fluid, for modifying the polarity and solvent characteristics of the critical fluid. The system comprises means in each of the boreholes for mixing critical fluids, reactants, catalysts or modifiers prior to entering the borehole. The system comprises a wellhead positioned on top of each of the boreholes for receiving the critical fluids and the electrical energy and transferring the critical fluids and the electrical energy down the borehole. Each of the wellheads comprises means for decoupling RF energy from thermocouple wires extending down the borehole.

The RF energy decoupling means comprises an RF choke connected to a filter capacitor for each thermocouple line. Also, the RF energy decoupling means comprises a hollow RF choke, the RF choke being formed by the thermocouple wires which are insulated and rotated to form a coil, each end of the thermocouple wires being connected to a filter capacitor. Each of the wellheads comprises a grounding screen positioned adjacent to an outer surface of each of the wellheads forming a ground plane to eliminate electromagnetic radiation eminating from around the wellhead for operator safety and performance. Each of the wellheads comprises a plurality of ground wires extending radially a distance of approximately one wavelength of the electrical energy frequency and spaced apart at predetermined intervals of approximately 15 degrees. Also, each of the wellheads comprises a grounding screen positioned adjacent to an outer surface of the wellhead forming a ground plane, and a plurality of ground wires extending radially from the perimeter of the grounding screen at a distance of approximately one wavelength of the electrical energy frequency and spaced apart at predetermined intervals. The system comprises an auxiliary well spaced apart from the plurality of boreholes and extending down to the body of fixed fossil fuels for extracting the released hydrocarbon fuels. The auxiliary well comprises an auxiliary wellhead, a well pipe extending downward from the wellhead, a pump coupled to the auxiliary wellhead for bringing fuel products up to a ground surface above the overburden, and a gas/liquid separator coupled to the auxiliary wellhead.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENTS

Figure 1:
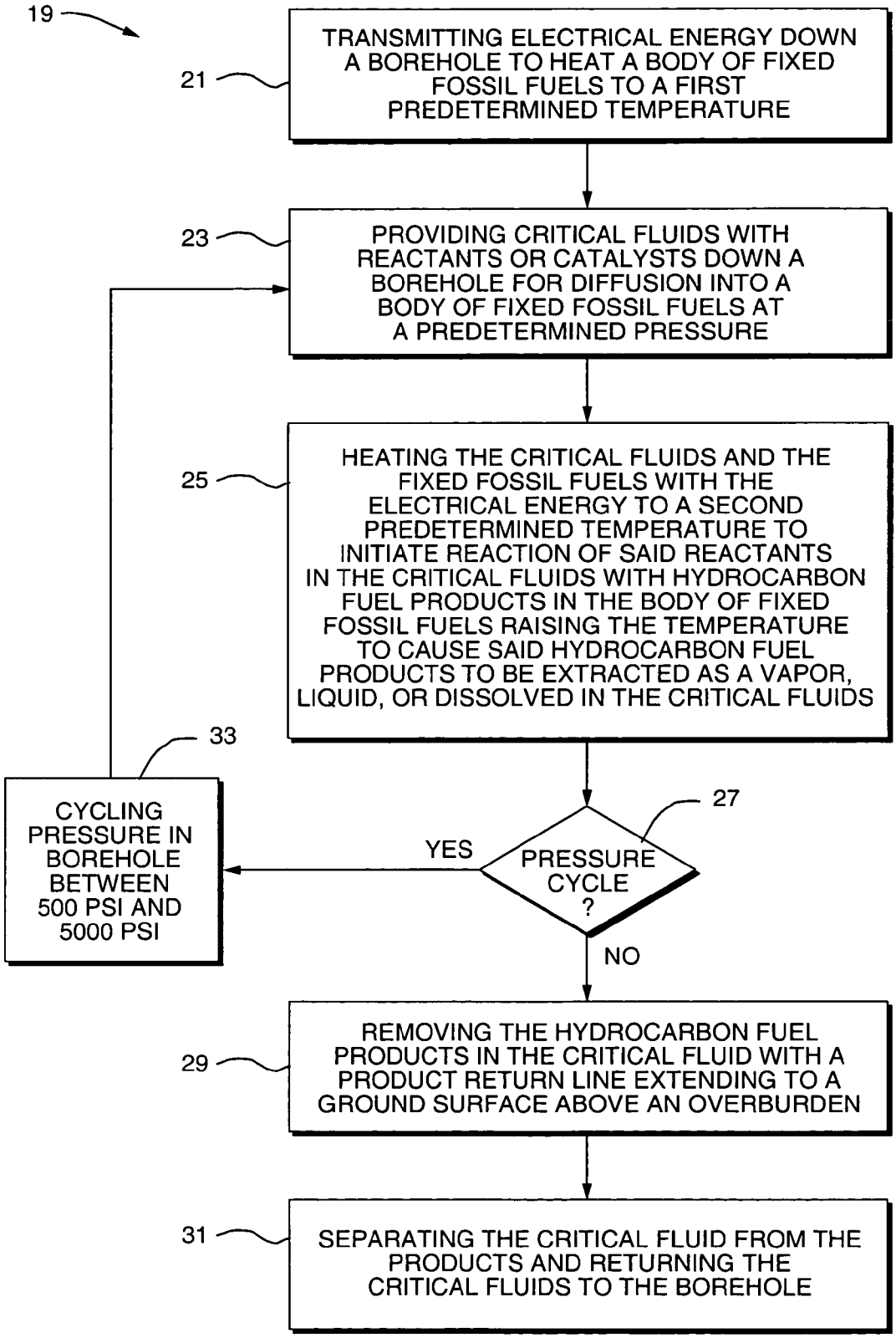
FIG. 1 is a flow chart of a method of producing hydrocarbon fuel products from a body of fixed fossil fuels according to the present invention.
Figure 2A:
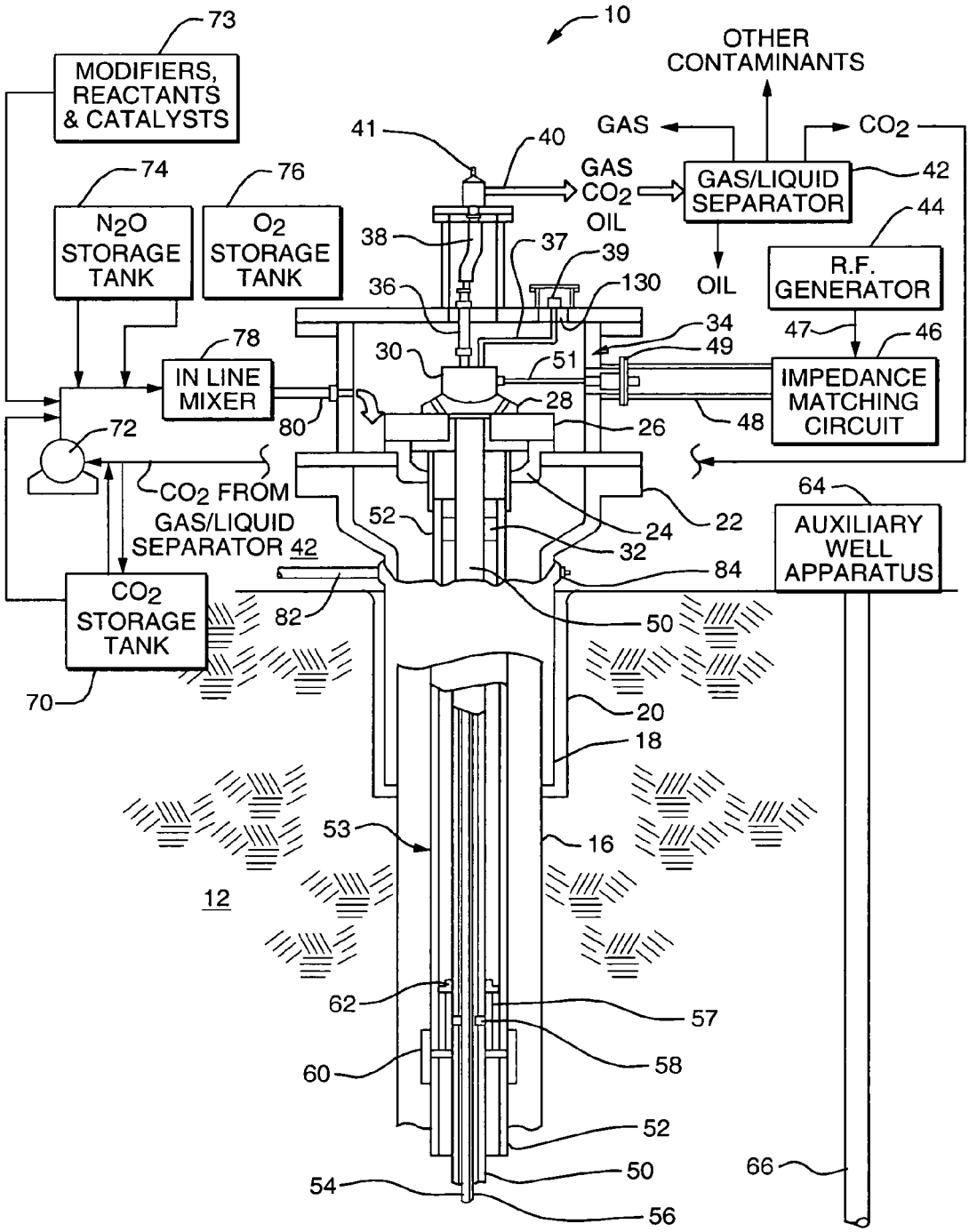
FIG. 2A and FIG. 2B in combination illustrate the system apparatus of the present invention including a sectional view of a wellhead and borehole RF applicator.
Figure 2B:
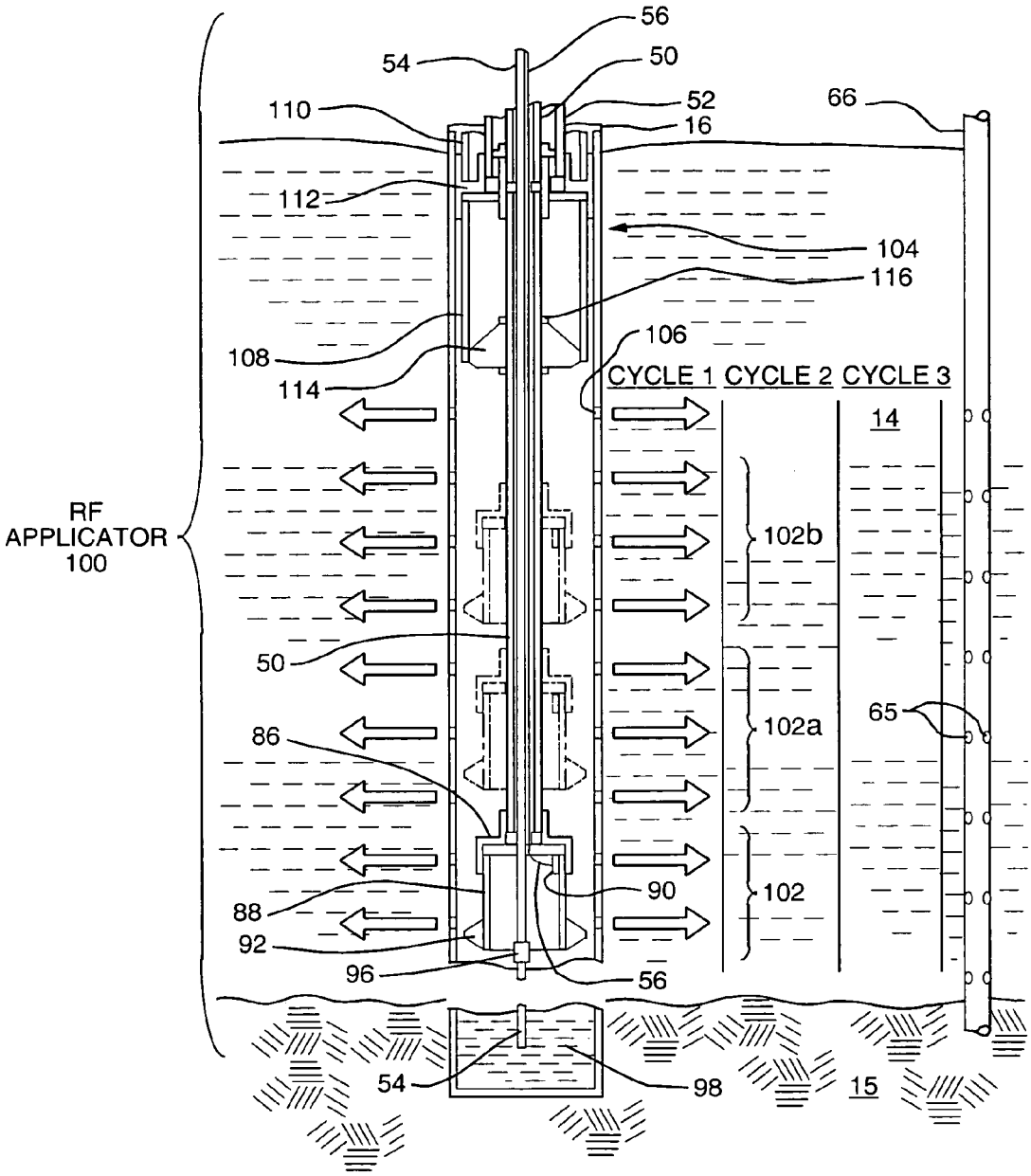

Referring to FIG. 1, FIG. 2A and FIG. 2B, FIG. 1 shows the steps of a method 19 of producing hydrocarbon fuel products, such as kerogen oil 98 and gas, from a body of fixed fossil fuels, such as oil shale 14, or tar sand beneath an overburden 12, or heavy petroleum from a spent well, or hydrocarbon fuels from coal, lignite or peat. FIGS. 2A and 2B together illustrate a system 10 for accomplishing the method of FIG. 1.

The method 19 comprises a step 21 of transmitting electrical energy to heat a body of fixed fossil fuels, such as oil shale 14, to a first predetermined temperature such as 150 degrees Celsius to begin the kerogen 98 pyrolysis process, of fracturing and modifying the shale sufficiently to allow the critical fluids to easily penetrate deep into the formation and to reduce the total energy input required in some instances.

Step 21 is a preheating step to increase the speed of the critical fluid diffusion and depth of the critical fluids penetration into the body of fixed fossil fuels. The electrical energy down a borehole is provided by an RF generator 44 which generates electromagnetic energy and known to one skilled in the art.

The next step 23 provides critical fluids (CF), such as carbon dioxide ($CO_2$), with reactants, such as nitrous oxide ($N_2O$) or oxygen ($O_2$), and catalysts may be added such as nano-sized iron oxide ($Fe_2O_3$), silica aerogel, and nano-sized Alumina ($Al_2O_3$) aerogel, down the borehole 16 for diffusion into the body of fixed fossil fuel or oil shale 14. However, in addition to the oxidants and catalysts, other modifiers can be added to the critical fluids to enhance the extraction of kerogen. Materials such as water or alcohols (e.g. methanol), can be added to modify the polarity and solvent characteristics of the critical fluid. Modifiers can also participate in reactions improving the product quality and quantity by the addition of hydrogen to kerogen (known as hydrogen donor solvents). Tetralin and methanol are examples of hydrogen donor solvents.

The introduction of critical fluids may be at various pressures, from 300 PSI to 5000 PSI. In the preferred embodiment of FIG. 1, the critical fluids are introduced at 700 psi prior to a second heating in step 25; in step 25 further heating of the critical fluids ($CO_2$) and the fixed fossil fuels occurs by transmitting electrical energy down the borehole 16 to reach a second predetermined temperature, in the range of 200 to 250 degrees Celsius. The lower initiation temperature uses less electrical energy and increases the overall process return on energy invested. This heating initiates an oxidation reaction, heating the critical fluids ($CO_2$) reactants, catalysts and the fixed fossil fuels with an oxidation of a small fraction of the fixed fossil fuels causing the temperature to rise further to approximately 450 degrees Celsius and converts the kerogen to hydrocarbon fuel products such as kerogen oil 98 and gas to be released and extracted as a vapor, liquid, or dissolved in the critical fluids. In step 27 a decision is made as to whether or not to perform pressure cycling by proceeding to step 33 where cycling pressure occurs in the borehole 16 between 500 psi and 5000 psi. Also, the pressure of the critical fluids may be increased at this point to 5000 PSI to assist in the removal of the fuel products; in step 29, removing the hydrocarbon fuel products in the critical fluid occurs with a product return line 54 or lines extending from down in the borehole 16 or other boreholes to the ground surface above the overburden 12. In step 31, when the hydrocarbon fuel products in the critical fluids leave the wellhead 34 via the product return line 40, they pass to a gas/liquid separator 42 for separating the critical fluid ($CO_2$) from the products and return the critical fluid to the borehole 16 or to storage.

Referring to FIG. 2A, a wellhead 34 is shown on top of a borehole 16 which has been drilled from the ground surface through the overburden 12, through the oil shale 14 and into a substrate 15. Overburden 12 may be sedimentary material forming a substantially gas tight cap over the oil shale 14 region. A seal to the overburden 12 is formed by a steel casing 18 extending from above the surface downwardly in borehole 16 to a point beneath the loose surface material, and the steel casing 18 is sealed to the walls of the borehole 16 by concrete region 20 surrounding the steel casing 18 which is well known to those of ordinary skill in the art. A lower portion of the wellhead 34, referred to as the wellhead casing 12 extends within the steel casing 18 and is attached to the steel casing 18, for example, by welding. The steel casing 18 design and application is determined by the condition of the specific site and formation and is known to one skilled in the art.

A critical fluid, such as carbon dioxide ($CO_2$), is provided in a $CO_2$ storage tank 70, and $CO_2$ may also be provided from the gas/liquid separator 42 which separates gases and liquids obtained from the external product return line 40 provided by the system 10. A pump or compressor 72 moves the $CO_2$ from the separator 42 to an in-line mixer 78. A nitrous oxide ($N_2O$) storage tank 74 and an oxygen ($O_2$) storage tank 76 are provided and their outputs are connected to the in-line mixer 78. Additional tanks 73 may be provided containing modifiers other reactants and other catalysts, such as nano-sized iron oxide ($Fe_2O_3$), silica aerogel or nano-sized Alumina ($Al_2O_3$). The mixture of the critical fluid, carbon dioxide ($CO_2$), the nitrous oxide ($N_2O$) and Oxygen ($O_2$) are provided by the in-line mixer 78 into the wellhead 34, down the borehole 16 and into the body of fixed fossil fuels for enhanced extracting, for example, of kerogen oil and gas 98 from oil shale 14.

Still referring to FIG. 2A, a center conductor 50 of a coaxial transmission line 53 is supported by the wellhead 34 being suspended via a landing nipple 30 and a support ring 28, from an insulator disk 26 and extending down to the center portion of the borehole 16. A ground shield or pipe 52 of the coax transmission line 53 provides a ground return path through a center conductor support 24. An RF generator 44, which provides electrical or electromagnetic energy in the frequency range between 100 KHZ and 100 MHZ, is coupled to an impedance matching circuit 46, and an RF coax line 48 from the impedance matching circuit 46 connects through a pressure window 49 to an input coax line 51 in the wellhead 34. The upper frequency of 100 MHZ is a practical limit based on the wavelength in shale. Oil Shale has a dielectric constant from 4 to 20 depending on the amount of kerogen and other materials in the shale. At 100 MHZ and lower, the wavelength in shale will be 1 meter and greater, resulting in sufficient penetration of the RF energy for efficient heating. The wavelength is inversely proportional to the frequency making lower frequencies even more effective. The input coax line 51 connects to the coax center conductor 50 via the landing nipple 30.

The product return line 54 is located within the coax center conductor 52, and it is supported by the landing nipple 30 in the wellhead 34. A ceramic crossover pipe 36 or other non-conductive pressure capable pipe isolates an external product return line 40 from RF voltage in the wellhead 34. A flexible coupling hose 38 is used to make up tolerances in the product return line 40 and to reduce strain on the ceramic crossover pipe 36. A feed port 41 is provided at the top of the wellhead 34 in the external product return line 40 for a gas lift line.

Referring to FIG. 2A and FIG. 2B, FIG. 2B shows a sectional view of an RF applicator 100. The coaxial transmission line 53 comprises several lengths of pipe (or coaxial ground shield) 52 joined together by a threaded couplings 60, and the upper end of the upper length of pipe 52 is threaded into an aperture in the center of the wellhead casing 22. The lower length of pipe 52 is threaded into an adapter coupling 112 which provides an enlarged threaded coupling to an upper coaxial stub 110 extending back up the borehole 16 for a distance of approximately an electrical eighth of a wavelength of the frequency to be radiated into the body of fixed fossil fuel or oil shale 14 by a radiator 102. A lower stub 108 of the same diameter as upper coaxial stub 110 extends downwardly from adapter coupling 112 for a distance equal to approximately an electrical quarter wavelength of the selected frequency band. If desired, a ceramic sleeve 106 having perforations may be placed in the fixed fossil fuel or oil shale 14 to prevent caving of the oil shale during the heating process.

The coaxial transmission line 53 (FIG. 2A) has the inner or center conductor 50 made, for example, of steel pipe lengths. The upper end of the upper section is attached to the support ring 28 and an insulator 32 spaces the inner conductor 50 electrically from the outer conductor 52. The inner conductor 50 extends downwardly through outer conductor 52 to a point beyond the lower end of tubular stub 108. An enlarged ceramic spacer 114 surrounds the inner conductor pipe 50 adjacent to a lower end of tubular stub 108 to space the inner conductor pipe 50 centrally within coaxial lower stub 108.

The region from the upper end of the upper stub or tubular member 110 to the lower end of lower stub or tubular member 108 is made an odd number of quarter wavelengths effective in oil shale in the operating frequency band of the device and forms an impedance matching section 104. More specifically, the distance from the adapter coupling 112 to the lower end of tubular member 108 is made approximately a quarter wavelength effective in air at the operating frequency of the system 10. The impedance matching section 104 of RF applicator 100 comprising lower stub 108 together with portions of the inner conductor 50 adjacent thereto act as an impedance matching transformer which improves the impedance match between coaxial transmission line 53 and the RF radiator 102.

The RF radiator 102 is formed by an enlarged section of a pipe or tubular member 88 threadably attached to the lower end of the lowest inner conductor 50 by an enlarging coupling adapter 86 and the lower end of enlarged tubular member 88 has a ceramic spacer 92 attached to the outer surface through to space member 88 from the borehole 16 surface (FIG. 2B). The RF radiator 102 is a half wave monopulse radiator and part of the RF applicator 100; it is described in U.S. Pat. No. 4,508,168 which, is incorporated herein by reference.

Still referring to FIG. 2B, the radiator 102 is shown in three positions within the borehole 16. When the kerogen oil 98 and gas extraction is completed to the desired level in the lowest position in the borehole 16, the radiator 102 is raised so that it is in the position of radiator 102*a*, and likewise it may be raised again to the position of radiator 102*b* and so on to other desired locations. At each position a sequence of heating cycles 1,2,3, etc. described hereinafter occurs for penetration of the oil shale 14 located at greater distances from the radiator 102.

Referring to FIGS. 2A and 2B, an auxiliary well pipe 66 is provided spaced apart from the borehole 16 for providing an additional means for removing the fuel products, such as kerogen oil and gas, from beneath the overburden 12. The lower portion of the auxiliary well pipe 66 comprises perforations 65 to allow the fuel products to enter the well pipe 66 and be removed.

Figure 8:
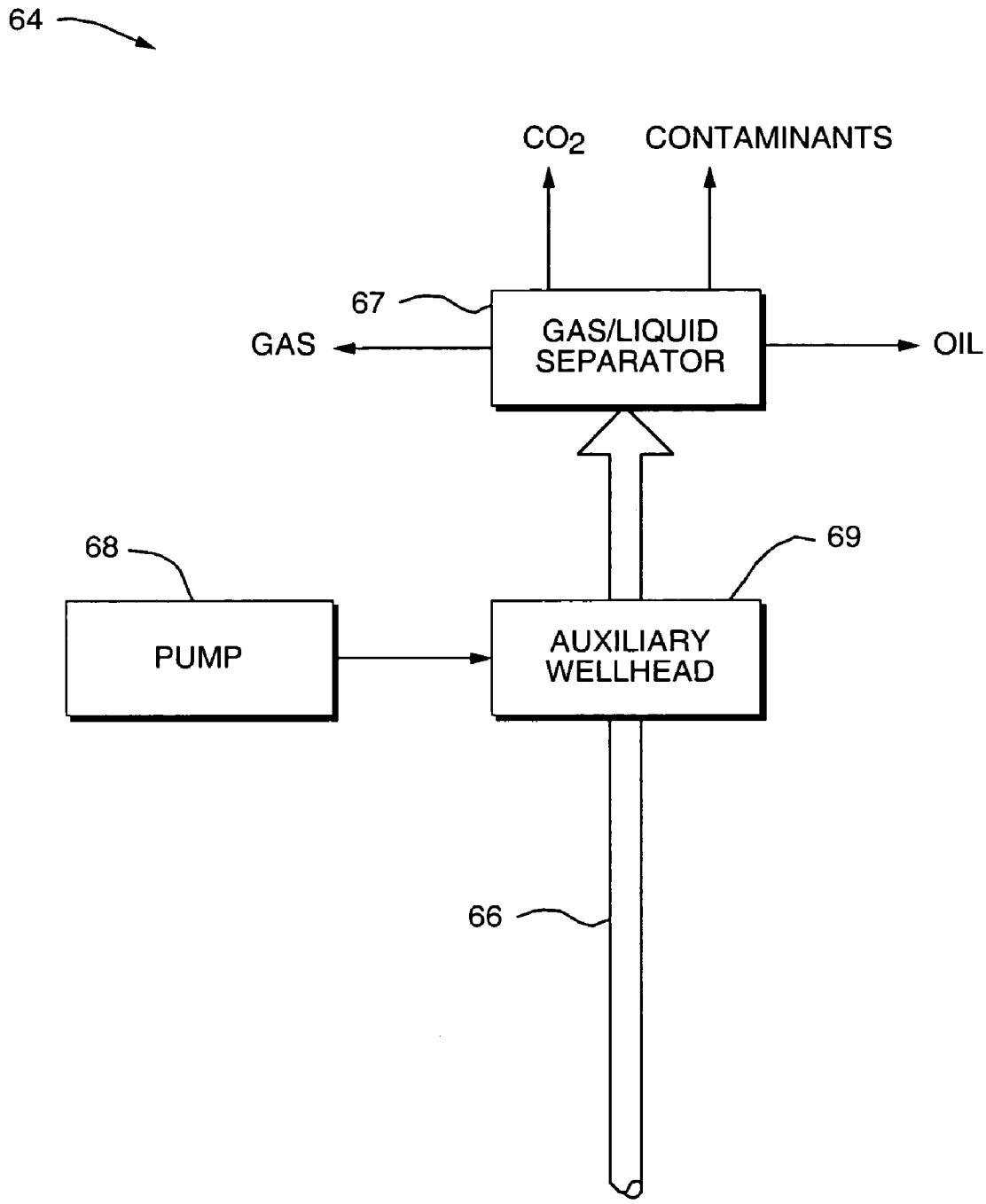
FIG. 8 is a block diagram of an auxiliary well apparatus.

Referring to FIGS. 2A, 2B and FIG. 8, FIG. 8 is a block diagram of an auxiliary well apparatus 64 from which the auxiliary well pipe 66 extends downward. The auxiliary well apparatus 64 comprises an auxiliary well head 69 on top of the auxiliary well pipe 66, a pump 68 for bringing the fuel products to the surface and a gas/liquid separator 67 which is similar to the gas/liquid separator 42 in FIG. 2A and separates the oil, gas, critical fluids and contaminants.

Figure 3A:
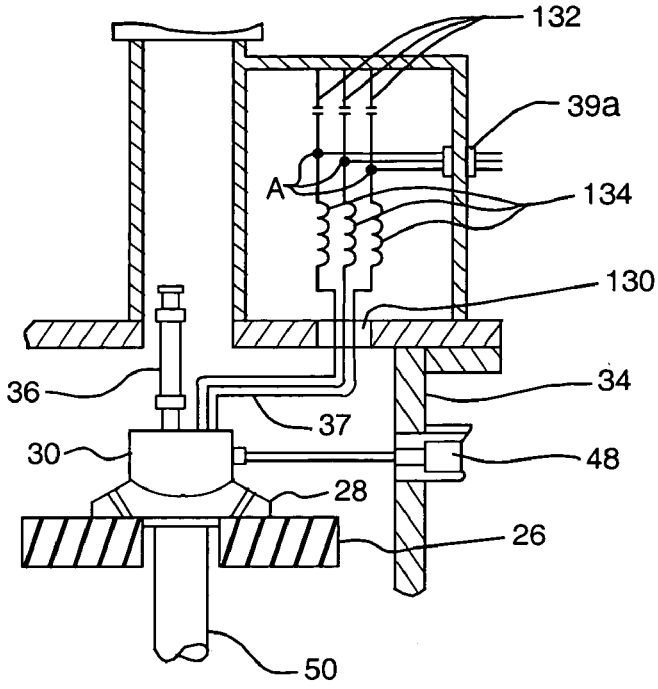
FIG. 3A illustrates a first apparatus for obtaining thermocouple data using an RF choke to decouple RF energy from the thermocouple lines.
Figure 3B:
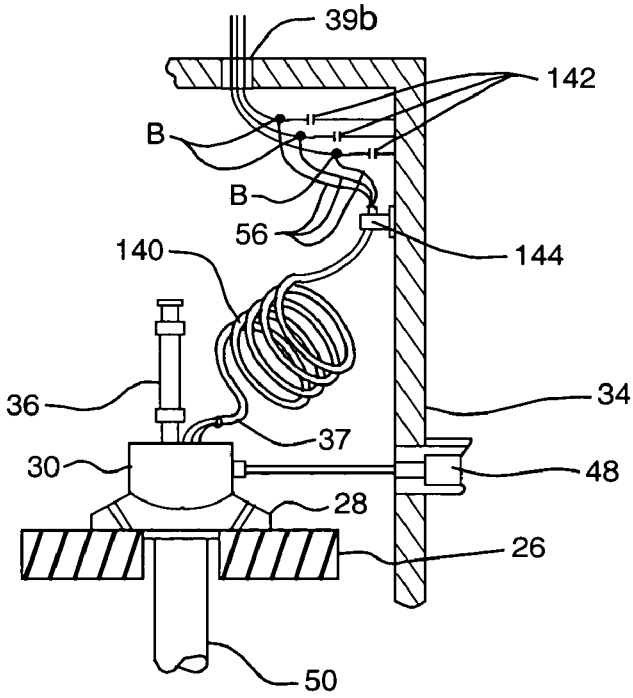
FIG. 3B illustrates a second apparatus for obtaining thermocouple data using the thermocouple wires to form a hollow RF choke to decouple RF energy from the thermocouple lines.

Referring to FIGS. 2A, 2B, 3A and 3B, FIG. 2A shows the thermocouple bundle 37 in the upper portion of wellhead 34 supported by the landing nipple 30, and are accessible through the thermocouple output connector 39 of the RF wellhead 34. In this arrangement RF voltage is present on the thermocouple lines 56 when transmitting RF energy down hole. FIG. 3A shows a first embodiment for obtaining thermocouple data using RF chokes to decouple the thermocouple bundle 37 from the RF voltage in the wellhead 34. FIG. 3B shows a second embodiment for obtaining thermocouple data using the thermocouple bundle 37 to form a hollow RF choke 140 to decouple RF energy for the thermocouple lines or wires 56 in the bundle 37. The thermocouple lines 56 extend down the borehole within the outer conductor 52.

Referring to FIG. 3A, the individual thermocouple wires or lines 56 in thermocouple bundle 37 are insulated from the wellhead 34, and they are connected to RF chokes 134 that are insulated from ground. Filter capacitors 132 are connected to the chokes 134 to eliminate radio frequency interference (RFI) in the thermocouple measurement system. The thermocouple output is at the connector 39*a* that terminates the wires from point A at the junction between the RF chokes 134 and the filter capacitors 132.

Referring to FIG. 3B, a special hollow RF choke 140 is wound using the insulated thermocouple bundle 37 which comprises the insulated thermocouple wires inside of it, and the RF choke 140 is used to decouple the RF energy. The end of choke 140 is grounded to the RF wellhead 34 by a clamp 144 and the thermocouple wires 56 are connected at points B to filter capacitors 142 and an output connector 39*b*.

Figure 4:
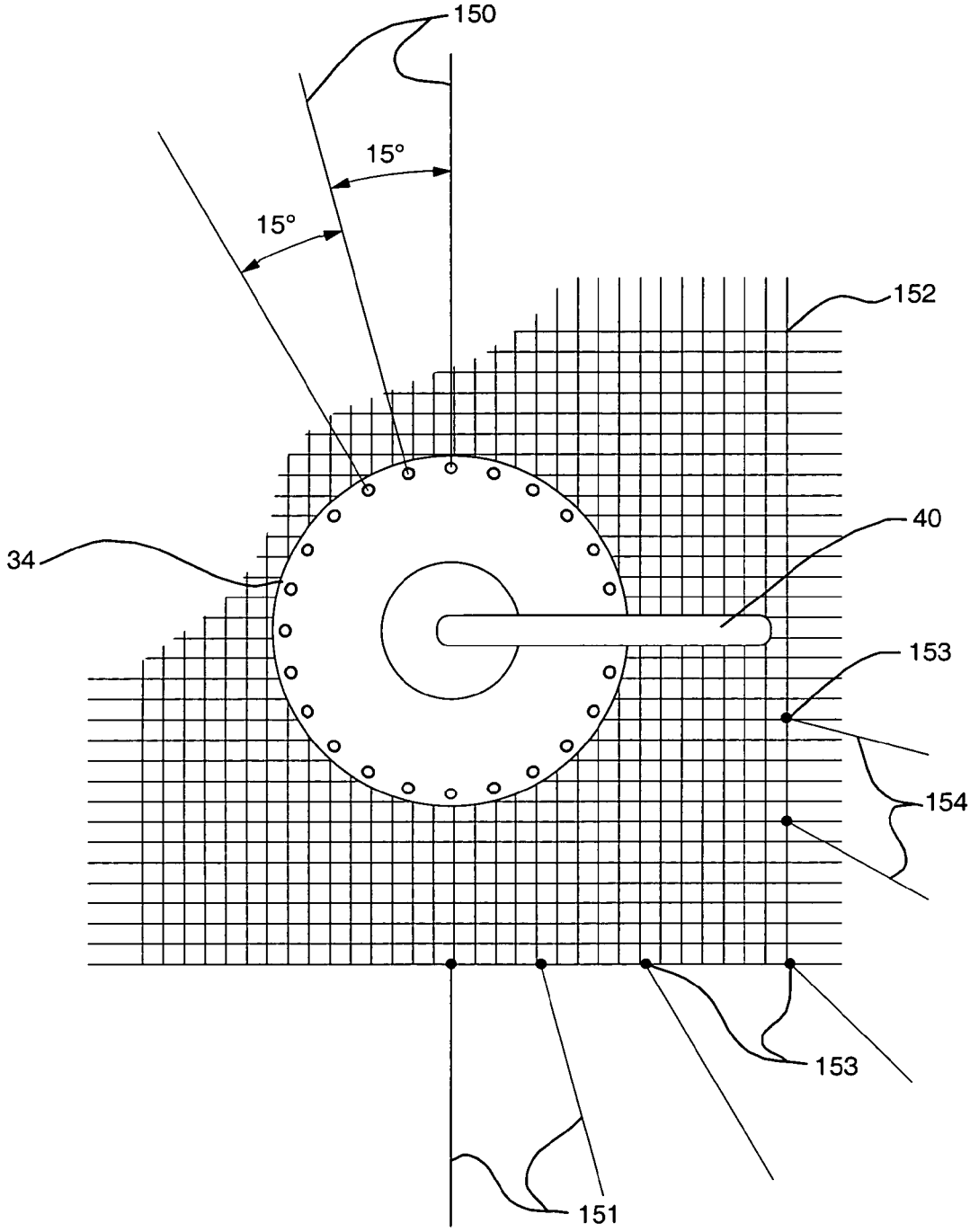
FIG. 4 is a plan view of a wellhead illustrating a ground plane at the surface having a surface grounding screen close to the wellhead to eliminate electromagnetic radiation for personnel safety and radial ground wires.

Referring now to FIG. 4, a plan view of a wellhead having a surface grounding screen 152 positioned close to and around the wellhead 34 forming a ground plane to eliminate electromagnetic radiator for personnel and equipment safety. The ground screen 152 comprises a small mesh (i.e. 2 inches×3 inches). In addition to or instead of the grounding screen 152, ground wires 150 may be used extending radially a distance of one wavelength (minimum) from the wellhead 34 at intervals of 15 degrees. When the grounding wires 151 are used in combination with the grounding screen 152, the grounding wires 151 are welded to the edges 153 of the grounding screen 152 to insure good RF contact. In an array of wellheads 34, the ground should be continuous from wellhead to wellhead with the radial grounding wires extending outward from the perimeter of the wellhead field.

Figure 5:
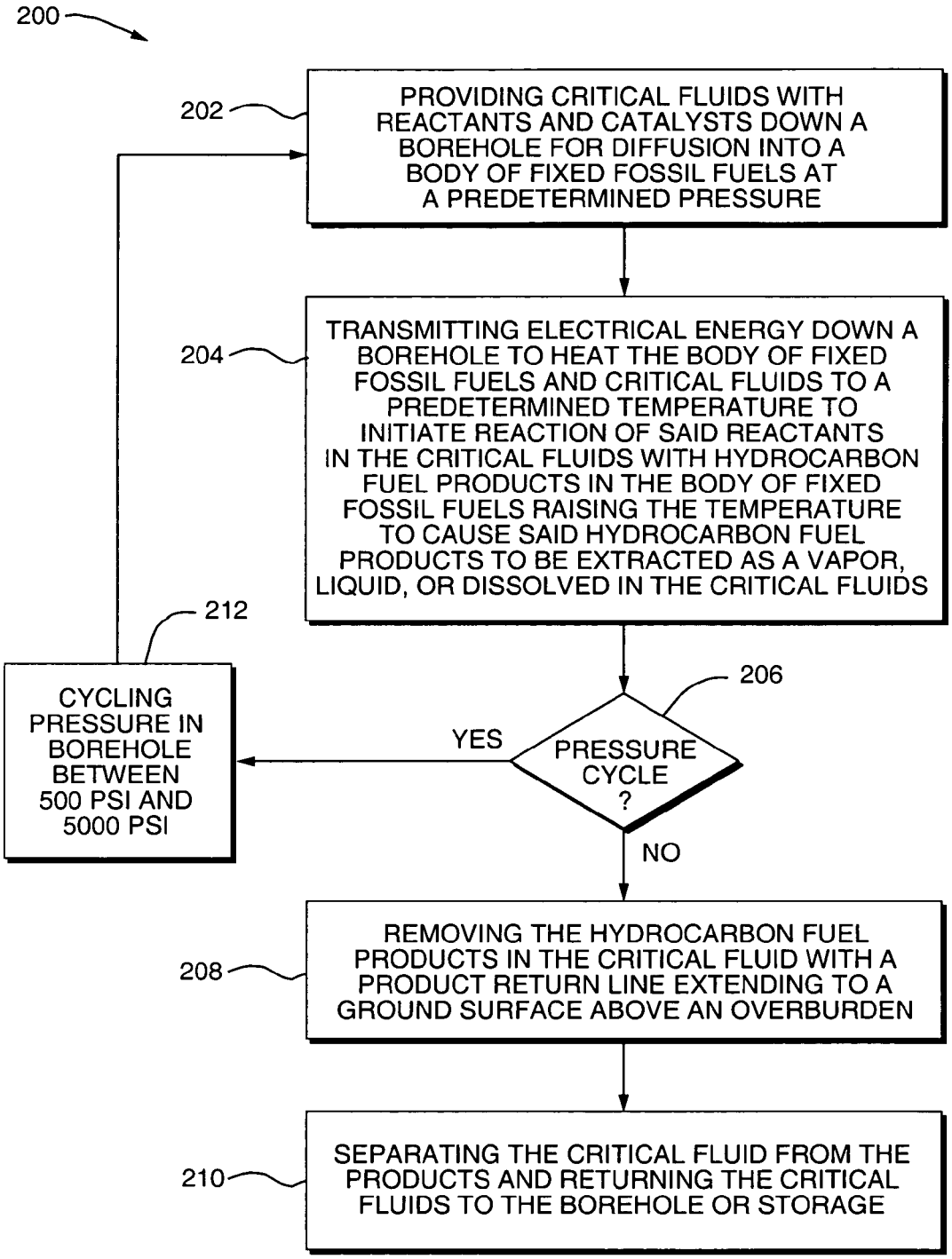
FIG. 5 is a flow chart of a first alternate embodiment of the method of producing hydrocarbon fuel products from a body of fixed fossil fuels without preheating according to the present invention.

Referring now to FIG. 5, a flow chart of a first alternate embodiment is shown of the method 200 of producing hydrocarbon fuel products from a body of fixed fossil fuels without preheating the body of fixed fossil fuels. In step 202, critical fluids such as carbon dioxide ($CO_2$), a reactant such as nitrous oxide ($N_2O$), and a catalyst such as nano-sized iron oxide ($Fe_2O_3$) are provided down the borehole 16 via wellhead 34 for diffusing into a body of fixed fossil fuels such as oil shale 14 at a predetermined pressure in the range of 300 to 5000 psi. The use of reactants and catalysts improves the overall efficiency and effectiveness of the method or process. In Step 204, electrical energy is provided by the RF generator 44 down the borehole 16 to heat the body of fixed fossil fuels and critical fluid ($CO_2$) to a predetermined temperature in the range of 200 to 250 degrees Celsius which causes a reaction of the reactant ($N_2O$) with hydrocarbon fuel products in the body of fixed fossil fuels raising the temperature to approximately 350 to 450 degrees Celsius at which point hydrocarbon fuel products are produced, such as kerogen oil 98 and gas 98 from the oil shale 14, which may be extracted as a vapor, liquid or dissolved in the critical fluid.

Still referring to FIG. 5, in step 206 a decision is made whether or not to cycle pressure. If a pressure cycle is performed, the cycling of pressure in the borehole 16 between 500 psi and 5000 psi is performed, and steps 202 and 204 are performed again as the pressure in the borehole 16 is cycled. However, during each cycle the pressure is controlled at the injection point. In step 208 removing the hydrocarbon fuel products in the critical fluid occurs continuously via the product return line 54 which extends to the ground surface above the overburden 12. In step 210 separating the critical fluid from the products is performed by the gas/liquid separator 42 (FIG. 2A), and the critical fluid ($CO_2$) is returned to the borehole 16 or to the $CO_2$ storage tank 70.

Figure 6:
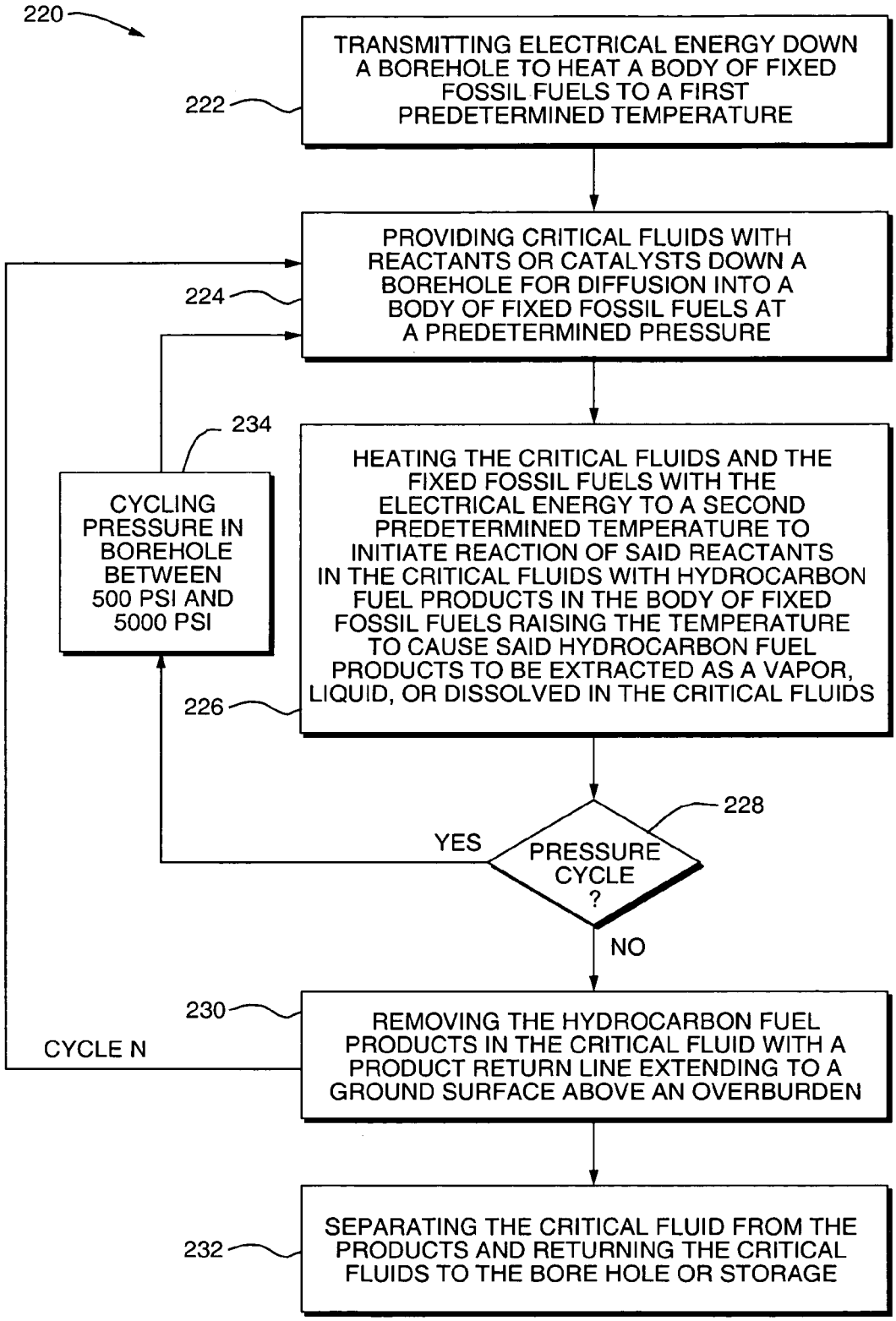
FIG. 6 is a flow chart of a second alternate embodiment of the method of producing hydrocarbon fuel products from a body of fixed fossil fuels having repetitive cycles according to the present invention.

Referring to FIG. 6, a flow chart of a second alternate embodiment is shown of the method 220 of producing hydrocarbon fuel products from a body of fixed fossil fuels having repetitive cycles N. The addition of repetitive cycle N allows for penetration of the heat and critical fluids to provide additional extraction at each elevation of the fixed fossil fuels, or for the movement of the RF radiator 102 and entire process up and down elevations within a borehole 16 at a fixed level of penetration. In step 222, electrical energy, which is provided by the RF generator 44, is transmitted down the borehole 16 to heat the body of fixed fossil fuels to a first predetermined temperature of approximately 150 degrees Celsius. In step 224, critical fluids such as carbon dioxide ($CO_2$), a reactant such as nitrous oxide ($N_2O$), and a catalyst such a nano-sized metal oxide aerogel are provided down the borehole 16 at a predetermined pressure of between 300 and 5000 psi. The predetermined pressure is formation dependant, taking into account variables such as depth of the borehole, richness of the shale deposit, local geothermal conditions and the specific processing objectives. These objectives are a combination of technical factors such as the solubility of the shale oil and economic factors such as optimum amount of oil to recover. They include variables that the operator may choose to optimize the process. An example includes a process optimized to recover a lower percentage of total recoverable fuel in a rapid fashion. Such a quick recovery of a low percentage of fuels would have shorter cycle times and fewer cycles than a process optimized to recover a high percentage of the fuel from a specific borehole area. Each site specific iteration of the process can use a different combination of temperature and pressure of the incoming critical fluid. For example, a 1 mhz RF transmitter may be used to heat the formation to 150 degree Celsius. A 50 meter area around the RF transmitter will reach 150 degrees Celsius in approximately 6 to 10 days. This preheating step in some situations increases the permeability of the shale, increasing the effectiveness and permeation distance and reducing the time required for permeation of the critical fluids. Still referring to this example, the critical fluids would then be allowed to penetrate and react with the shale for a period of 21 to 90 days, depending on site specifics such as temperature and richness and porosity and depending on the parameters desired for that particular extraction, such as depth of penetration and cycle time. In a similar example, without the use of RF preheating, the critical fluids may be allowed to penetrate and react for a longer period of time, for example 120 days, also depending on site specifics and extraction parameters and goals. In some instances, the critical fluid can be pressurized and preheated. For example, if the critical fluids are preheated to 200 degrees Celsius, they would typically be injected into the borehole at about 3000 psi. If the critical fluids are injected with no preheating, and remain at their typical storage temperature of −20 degrees Celsius, they could be injected at the storage pressure of 300 psi, if that temperature/pressure combination meets favorably with the other variables at that site. Naturally, the actual temperature and pressure of the critical fluids at the bottom of the borehole 16 vary, being affected by several local conditions including depth, porosity of the shale, and geothermal temperatures.

Still referring to FIG. 6, in step 226 electrical energy from the RF generator 44 is provided down borehole 16 to further heat the critical fluids and the fixed fossil fuels to a second predetermined temperature in the range of 200 to 250 degrees Celsius which causes a reaction of the reactant ($N_2O$) with hydrocarbon fuel products in the body of fixed fossil fuels raising the temperature to approximately 400 degrees Celsius at which point hydrocarbon fuel products are produced, such as kerogen oil 98 and gas from the oil shale 14. In step 228, a decision is made whether or not to cycle pressure. If pressure cycling is performed, the cycling of pressure in borehole 16 occurs between 500 psi and 5000 psi, and steps 224 and 226 are performed again as the pressure in borehole 16 is cycled. However, during each cycle the pressure is controlled at the injection point. During step 226, hydrocarbon fuel products are produced, and in step 230, removing the hydrocarbon fuel products in the critical fluid occurs continuously via the product return line 54 which extends to the ground surface. Cycling back to step 224 and then step 226 N times, where the RF energy initiates oxidation with the hydrocarbon fuel products, and performing pressure cycling while performing step 224 and 226 produces additional hydrocarbon fuel products. In step 232, separating the critical fluid from the products is performed by the gas/liquid separator 42 and the critical fluid ($CO_2$) is returned to the borehole 16 or to the $CO_2$ storage tank 70. The gas/liquid separator 42 may be embodied by a Horizontal Longitudinal Flow Separator (HLF) manufactured by NATCO Group, Inc., of 2950 North Loop West, Houston, Tex. 77092.

Figure 7:
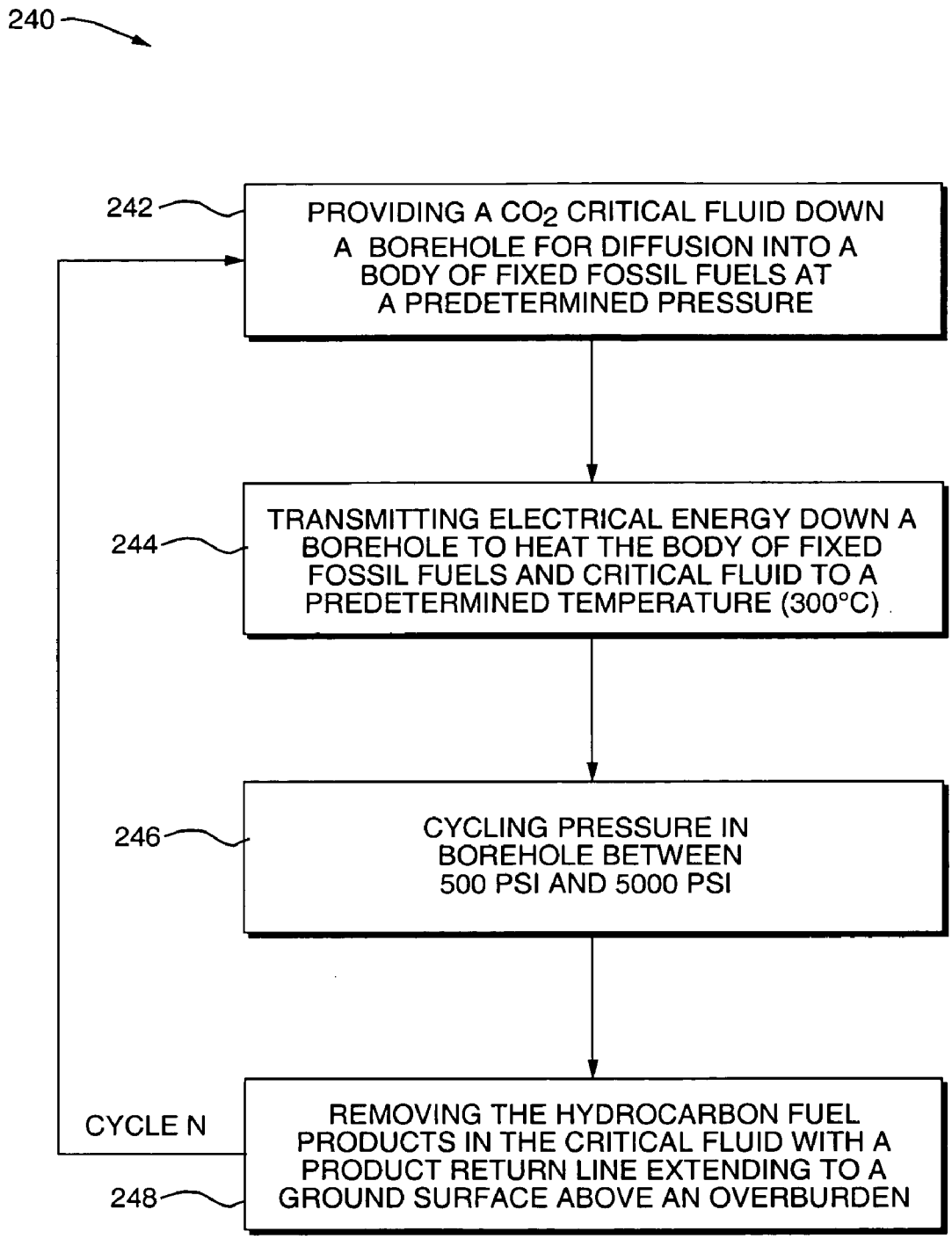
FIG. 7 is a flow chart of a third alternate embodiment of the method of producing hydrocarbon fuel products from a body of fixed fossil fuels without the use of reactants or catalysts according to the present invention.

Referring to FIG. 7, a flow chart of a third alternate embodiment is shown of the method 240 of producing hydrocarbon fuel products from a body of fixed fossil fuels without the use of reactants or catalysts, which may be more cost effective or environmentally acceptable, for certain site specific applications. In step 242, a $CO_2$ critical fluid is provided down the borehole 16 for diffusion into the body of fixed fossil fuels at a predetermined pressure in the range of 300 to 5000 psi. In step 244, electrical energy is transmitted down the borehole 16 by RF generator 44 to heat the body of fixed fossil fuels and critical fluid to a predetermined temperature of 300 to 400 degrees Celsius. For example, a 1 mhz RF transmission will heat 50 meters of surrounding area to 280 degrees Celsius in approximately 12-14 days, and to 380 degrees Celsius in 3 to 4 weeks depending on local site conditions. In step 246, cycling pressure in borehole 16 is performed between 500 psi and 5000 psi. In step 248, removing the hydrocarbon fuel products in the critical fluid occurs continuously via the product return line 54 which extends up to the ground surface and through the wellhead 34. As the hydrocarbon fuels products are removed, the method 240 cycles back to step 242 and repeats steps 242, 244 and 246 N times producing more products until a reduction in such products occurs.

Figure 9:
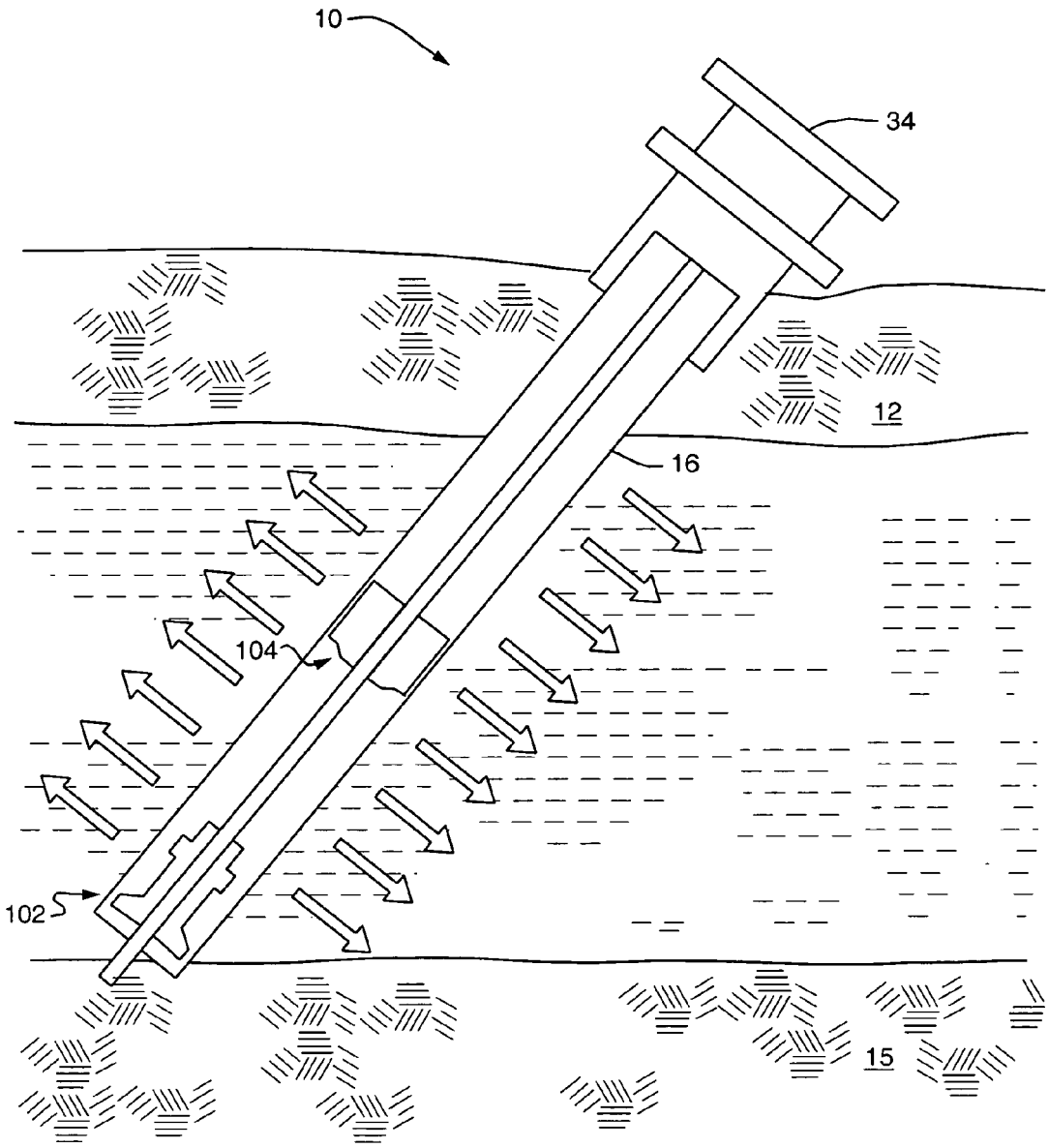
FIG. 9 is a simplified diagram of the system in FIGS. 2A and 2B showing the well head, borehole and RF applicator positioned in the ground at a predetermined angle.

Referring to FIG. 9, an alternate embodiment representation of system 10 of FIGS. 2A and 2B is shown simplified with only the well head 34, borehole 16, and applicator 102, positioned in the ground through the overburden 12 at a predetermined angle relative to vertical (as shown in FIGS. 2A and 2B). This angular arrangement of system 10 is used to provide desired heating and distribution of the critical fluids in various applications and compositions, such as a landfill or peat bog. Angular borehole arrangements may also be necessary to avoid various underground obstacles such as foundations or aquifers when a vertical borehole will meet with interference. The use of angular boreholes is well known to those skilled in the art and can be applied to both this apparatus and method. The RF applicator 102 is utilized in much the same fashion as in FIGS. 2A and 2B with the angular arrangement of the borehole being determined by the local conditions at the site, so as to extract the maximum contaminants or fuels using the fewest number of boreholes (16) and the least amount of electrical energy and the least volume of critical fluids to accomplish the goals of that particular project. The predetermined angle, pressure and temperature is site dependant.

The predetermined pressure is formation dependant, taking into account variables such as depth of the borehole, richness of the shale deposit or concentration of contaminants, local geothermal conditions and the specific processing objectives. The objectives are a combination of technical factors such as the solubility of the shale oil and economic factors such as optimum amount of oil to recover or the amount of hydrocarbon fuels or contaminants to recover from a peat bog, remediation site, etc. They include variables that the operator may choose to optimize the process. An example includes a process optimized to recover a lower percentage of total recoverable fuel in a rapid fashion. Such a quick recovery of a low percentage of fuels would have shorter cycle times and fewer cycles than a process optimized to recover a high percentage of the fuel from a specific borehole area. Each site specific iteration of the process can use a different combination of temperature and pressure of the incoming critical fluid. In some instances, the critical fluid can be pressurized and preheated, for example, if the critical fluids are preheated to 200 degrees Celsius, they would typically be injected into the borehole at about 3000 psi. If the critical fluids are injected with no preheating, and remain at their typical storage temperature of −20 degrees Celsius, they could be injected at the storage pressure of 300 psi if that temperature/pressure combination meets favorably with the other variables at that site. Naturally, the actual temperature and pressure of the critical fluids at the bottom of the borehole 16 vary, being affected by several local conditions including depth, porosity of the site, and geothermal temperatures.

Figure 10:
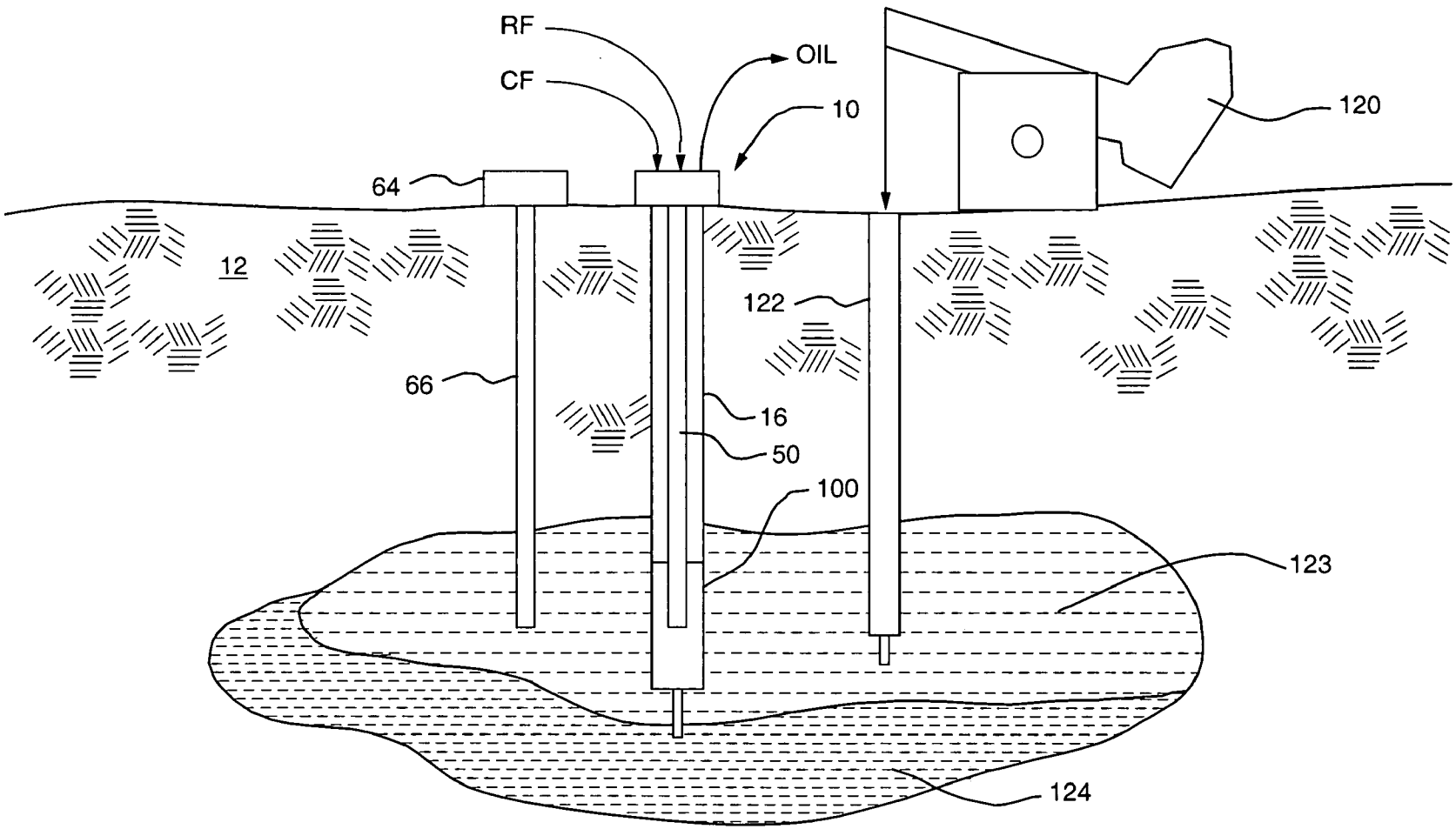
FIG. 10 is an illustration of the application of the system of the present invention as shown in FIGS. 2A and 2B in an aging oil well comprising heavy oil.

Referring to FIG. 10, the system 10 of FIGS. 2A and 2B is shown having borehole 16 extending through the overburden 12 down into an aging oil well where most of an oil deposit 123 was removed and heavy oil 124 remains. Critical fluids in combination with RF energy (system 10) are used to extract the heavy oil to the surface via the product return line 54 in system 10, or via the auxiliary well pipe 66 and auxiliary well apparatus 64, or via the original oil well apparatus 120 and borehole 122. The method described in FIG. 1, FIG. 5, FIG. 6 and FIG. 7 with or without the use of reactants in the critical fluids may be used to recover the remaining heavy oil 124.

The methods of FIGS. 1, 5, 7, 9 and 11 and the apparatus of FIGS. 2A and 2B may be used for remediation of oil, other hydrocarbon fuels and contaminants from a spill site, land fill or other environmentally sensitive situations by using a combination of electrical energy and critical fluids. As described in FIG. 1, step 23, FIG. 5, Step 202 and FIG. 6, Step 224, critical fluids are supplied to the formation via the borehole 16. These critical fluids may have reactants or catalysts specifically chosen to physically or chemically bind or chemically neutralize or dissolve various hydrocarbon fuels, chemicals or undesired contaminants at the site. These reactants or catalysts provide additional cleansing, working with the natural dilutent and scrubbing and transport properties of the critical fluids. Some of these reactants may be heat activated by the RF, and some may not require heat activation. Some may be designed to be delivered and remain in-situ in the case of neutralizers and some may be designed to bind and carry undesired or desired compounds out of the site along with the critical fluids. For example, transuranic elements are a typical contaminate left behind by weapons manufacturing processes. These are difficult to remove by conventional methods, however the addition of nano-sized chelating agents to the critical fluids helps suspend the Uranium in the $CO_2$ for transport. The RF heat adds additional efficiency and thermal gradient movement to the process for this type of difficult site remediation. Another example is the trichloroethane cleaning solvents many factories and municipalities used and dumped into the environment in years past, or creosotes which were typically deposited by town gas plants. These contaminants are easily diluted and scrubbed with the natural properties of critical $CO_2$ and more thoroughly removed with the addition of RF heating.

Figure 11:
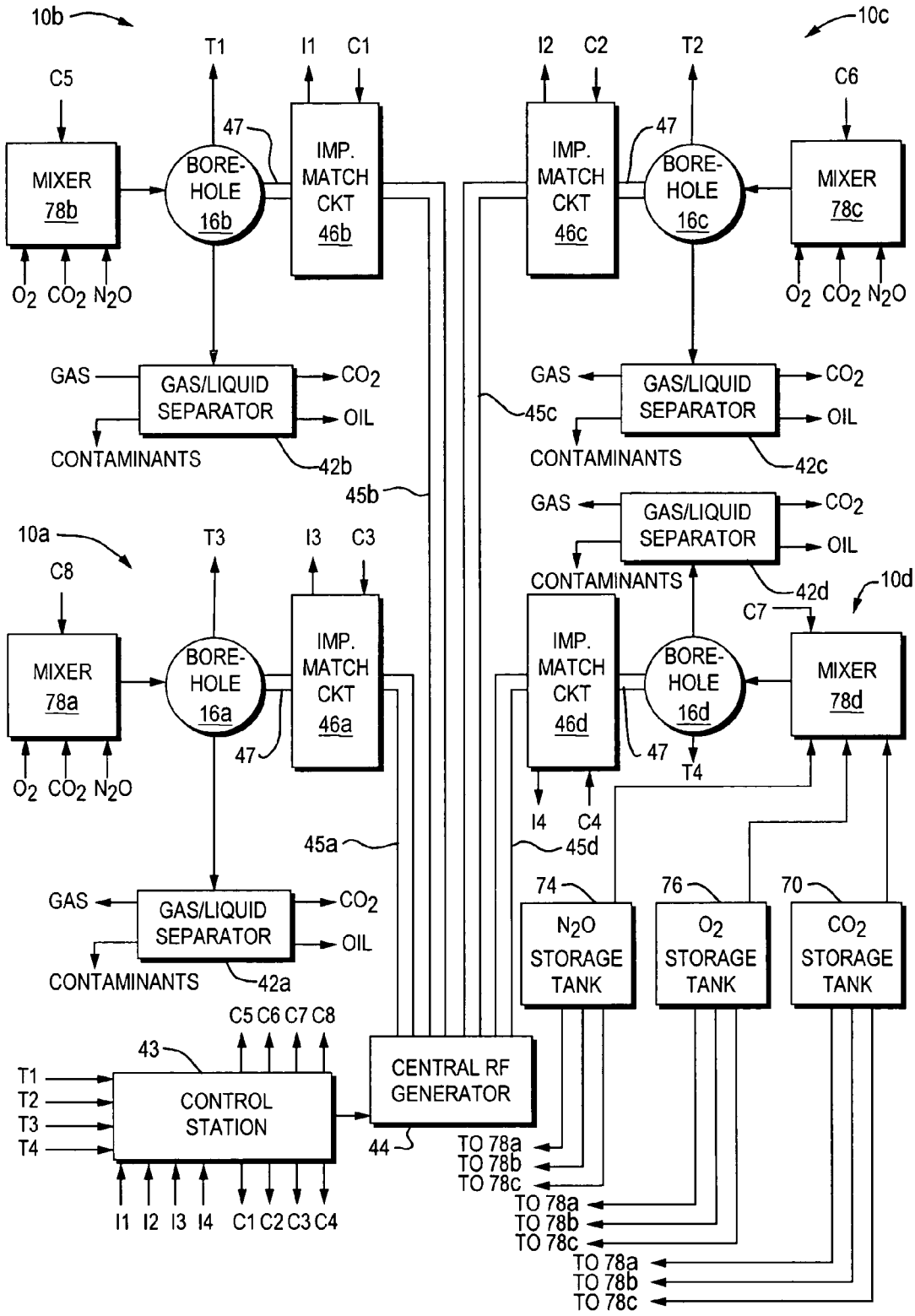
FIG. 11 is a plan view of a plurality of systems of FIGS. 2A and 2B showing a central RF generator and a control station.

Referring now to FIG. 11, a plan view of a plurality of systems 10*a*-10*d* of FIGS. 2A and 2B in a well field are shown having a central RF generator 44 connected to a control station 43. A plurality of boreholes 16*a*-16*d* are spaced apart in the well field by distances as much as several hundred feet and connected by a coax cabling 45*a*-45*d* through impedance matching circuits 46*a*-46*d* to the central RF generator 44, that is slaved to the control station 43. Critical fluids are provided to the boreholes 16*a*-16*d* via piping from in-line mixers 78*a*-78*d* which connect to the $O_2$ storage tank 76, the $N_2O$ storage tank 74 and the $CO_2$ storage tank 70. Product from the boreholes 16*a*-16*d* is routed to the gas/liquid separators 42*a*-42*d* where oil, gas and $CO_2$ products and contaminants are derived. The RF power from central RF generator 44 may be shifted sequentially in any desired pattern to different radiators in different boreholes 16*a*-16*d* from a single RF generator based on inputs I1-I4 received from the control station 43. Similarly, the critical fluids may be shifted from one borehole to another as desired, based on inputs from the control station 43. Signals I1-I4 are fed to the control station 43 from the impedance matching circuits 46*a*-46*d*, as well as temperature monitoring signals T1-T4 measured in the boreholes 16 at subsurface layers. These inputs are used to monitor and/or adjust the frequency and impedance matching of the central RF generator 44 via control signals C1-C4 from the control station 43, and also to control the injection of critical fluids into the boreholes 16*a*-16*d*. The number of systems 10*a*-10*d* may be increased or decreased depending on the size of the well field being worked to obtain the oil, gas or $CO_2$.

Further, a plurality of auxiliary production or extraction wells comprising pipes 66 and well apparatus 64 shown in FIGS. 2A and 2B may be added to the well field to increase the extraction of fuel products or contaminants. For example, in a remediation application, these additional auxiliary extraction wells, spaced at 50 meters or so from each RF/CF system 10, may help create a "flow" of contaminants out of a spoiled zone, while the RF/CF are left "on" and in the "pressure" mode, and the simple extraction wells are left in the "on" low pressure (extract) mode so that the critical fluids "flow" from the pump 72 high pressure side to the extraction well low pressure side and bring the contaminants with them. This operation may operate with or without the use of aerogels and catalysts. The extraction wells may be turned "off" for a period of time to allow pressure to build and to allow the CF to dilute and scrub, then turned back "on" to encourage the flow.

This invention has been disclosed in terms of certain embodiment. It will be apparent that many modifications can be made to the disclosed methods and apparatus without departing from the invention. Therefore, it is the intent of the appended claims to cover all such variations and modification as come within the true spirit and scope of this invention.

What is claimed is:

1. A system for producing hydrocarbon fuels from a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden and wherein the means for initiating a reaction with the body of fixed fossil fuels comprises a catalyst including one of nano-sized iron oxide ($Fe_2O_3$), silica aerogel, and nano-sized alumina ($AL_2O_3$) aerogel.

2. A system for producing hydrocarbon fuels from a body of fixed fossil fuels beneath an overburden. comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden and wherein the system comprises means, added to the critical fluid, for modifying the polarity and solvent characteristics of the critical fluid.

3. A system for producing hydrocarbon fuels from a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden and wherein the system comprises means for mixing critical fluids, reactants, catalysts or modifiers prior to entering the borehole.

4. A system for producing hydrocarbon fuels from, a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden, wherein the system comprises a wellhead positioned on top of the borehole for receiving the critical fluid and the electrical energy and transferring the critical fluid and the electrical energy down the borehole, and wherein said wellhead comprises means for RF energy decoupling including an RF choke connected to a filter capacitor for each thermocouple line extending down the borehole.

5. A system for producing hydrocarbon fuels from a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden, wherein the system comprises a wellhead positioned on top of the borehole for receiving the critical fluid and the electrical energy and transferring the critical fluid and the electrical energy down the borehole, and wherein said wellhead comprises means for RF energy decoupling including a hollow RF choke, the RF choke being formed by thermocouple wires extending down the borehole which are insulated and rotated to form a coil, each end of the thermocouple wires being connected to a filter capacitor.

6. A system for producing hydrocarbon fuels from a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden, wherein the system comprises a wellhead positioned on top of the borehole for receiving the critical fluid and the electrical energy and transferring the critical fluid and the electrical energy down the borehole, and wherein the wellhead comprises a plurality of ground wires extending radially a distance of approximately one wavelength of the electrical energy frequency and spaced apart at predetermined intervals of approximately 15 degrees.

7. A system for producing hydrocarbon fuels from a body of fixed fossil fuels beneath an overburden comprising:

means for transmitting electrical energy down a borehole to heat the body of fixed fossil fuels comprising an RF generator coupled to a transmission line for transferring electrical energy to an RF applicator;

means for providing a critical fluid down the borehole for diffusion into the body of fixed fossil fuels at a predetermined pressure;

means included with the critical fluid for initializing a reaction with the body of fixed fossil fuels to cause the hydrocarbon fuels to be released;

means for cycling the pressure within the borehole between 500 psi and 5000 psi, and wherein the system further comprises means for removing the hydrocarbon fuels from the borehole to a ground surface above the overburden, wherein the system comprises a wellhead positioned on top of the borehole for receiving the critical fluid and the electrical energy and transferring the critical fluid and the electrical energy down the borehole, and wherein the wellhead comprises a grounding screen positioned adjacent to an outer surface of the wellhead forming a ground plane, and a plurality of ground wires extending radially from the perimeter of the grounding screen at a distance of approximately one wavelength of the electrical energy frequency and spaced apart at predetermined intervals.

8. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden and wherein the means included with the critical fluids for initiating a reaction with the body of fixed fossil fuels comprises a catalyst including one of nano-sized iron oxide ($Fe_2O_3$), silica aerogel, and nano-sized alumina ($AL_2O_3$) aerogel.

9. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden and wherein the system comprises means, added to the critical fluid, for modifying the polarity and solvent characteristics of the critical fluid.

10. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden and wherein the system comprises means in each of the boreholes for mixing critical fluids, reactants, catalysts or modifiers prior to entering the borehole.

11. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden, wherein the system comprises a wellhead positioned on top of each of the boreholes for receiving critical fluids and the electrical energy and transferring the critical fluids and the electrical energy down the borehole, and wherein said wellhead comprises means for RF energy decoupling including an RF choke connected to a filter capacitor for each thermocouple line extending down the borehole.

12. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden, wherein the system comprises a wellhead positioned on top of each of the boreholes for receiving the critical fluids and the electrical energy and transferring the critical fluids and the electrical energy down the borehole, and wherein said wellhead comprises means for RF energy decoupling including a hollow RF choke, the RF choke being formed by thermocouple wires extending down the borehole which are insulated and rotated to form a coil, each end of the thermocouple wires being connected to a filter capacitor.

13. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF generator coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden, wherein the system comprises a wellhead positioned on top of each of the boreholes for receiving the critical fluids and the electrical energy and transferring the critical fluids and the electrical energy down the borehole and wherein each of the wellheads comprises a plurality of ground wires extending radially a distance of approximately one wavelength of the the electrical energy frequency and spaced apart at predetermined intervals of approximately 15 degrees.

14. A system for producing hydrocarbon fuels from a body of fixed fossil fuels beneath an overburden comprising a plurality of boreholes, each of the boreholes comprising:

means for transmitting electrical energy down each of the boreholes to heat the body of fixed fossil fuels comprising a central RF coupled to transmission lines for transferring electrical energy to an RF applicator in each of the boreholes;

means for providing critical fluids down each of the boreholes for diffusion into the body of fixed fossil fuels at a predetermined pressure;

means included with the critical fluids for initializing a reaction with the body of fixed fossil fuels to cause the hydrocarbon fuels to be released;

means for controlling the electrical energy and the critical fluids to each of the boreholes; and means for cycling the pressure within the borehole between 500 psi and 5000 psi; and wherein the system further comprises means for removing the hydrocarbon fuels from the borehole to a ground surface above the overburden, wherein the system comprises a wellhead positioned on top of each of the boreholes for receiving the critical fluids electrical energy and transferring the critical fluids and the electrical energy down the borehole and wherein each of the wellheads comprises a grounding screen positioned adjacent to an outer surface of the wellhead forming a ground plane, and a plurality of ground wires extending radially from the perimeter of the grounding screen at a distance of approximately one wavelength of the electrical energy frequency and spaced apart at predetermined intervals.

15. A system for producing hydrocarbon fuels from a body of fixed fossil fuels beneath an overburden comprising:

means for transmitting electrical energy down a borehole to heat the body of fixed fossil fuels;

means for providing a critical fluid down said borehole for diffusion into the body of fixed fossil fuels at a predetermined pressure;

means included with the critical fluid for initializing a reaction with the body of fixed fossil fuels to cause the hydrocarbon fuels to be released;

a wellhead positioned on top of said borehole for receiving said critical fluid and said electrical energy and transferring said critical fluid and said electrical energy down said borehole, means for decoupling RF energy from thermocouple wires extending down said borehole using an RF choke connected to a filter capacitor for each thermocouple line; and means for cycling the pressure within the borehole between 500 psi and 5000 psi and wherein the system further comprises means for removing the hydrocarbon fuels from the borehole to a ground surface above the overburden.

16. The system as recited in claim 15 wherein said RF energy decoupling means comprises a hollow RF choke, said hollow RF choke being formed by said thermocouple wires which are insulated and rotated to form a coil, each end of said thermocouple wires being connected to a filter capacitor.

17. The system as recited in claim 15 wherein said wellhead comprises a grounding screen positioned adjacent to an outer surface of said wellhead forming a ground plane to eliminate electromagnetic radiation emanating from around said wellhead for operator safety and performance.

18. The system as recited in claim 15 wherein said wellhead comprises a plurality of ground wires extending radially a distance of approximately one wavelength of the electrical energy frequency and spaced apart at predetermined intervals of approximately 15 degrees.

19. The system as recited in claim 15 wherein said wellhead comprises a grounding screen positioned adjacent to an outer surface of the wellhead forming a ground plane, and a plurality of ground wires extending radially from a perimeter of said grounding screen at a distance of approximately one wavelength of the electrical energy frequency and spaced apart at predetermined intervals.

20. A system for producing hydrocarbon fuels from a body of fixed fossil fuels beneath an overburden including a plurality of boreholes, said system comprising:

means for transmitting electrical energy down each of said boreholes to heat said body of fixed fossil fuels;

means for providing a critical fluid down each of said boreholes for diffusion into said body of fixed fossil fuels at a predetermined pressure;

means for cycling the pressure within the borehole between 500 psi and 5000 psi;

means, included with said critical fluid, for initializing a reaction with the body of fixed fossil fuels to cause said hydrocarbon fuels to be released;

means for controlling the electrical energy and the critical fluid to each of the boreholes;

a wellhead positioned on top of a predetermined number of said boreholes for receiving said critical fluids and said electrical energy and transferring said critical fluids and said electrical energy down said borehole; and said wellhead comprises means for decoupling RF energy from thermocouple wires extending down said borehole using an RF choke connected to a filter capacitor for each thermocouple line and wherein the system further comprises means for removing the hydrocarbon fuels from the borehole to a ground surface above the overburden.

21. The system as recited in claim 20 wherein said RF energy decoupling means comprises a hollow RF choke, said hollow RF choke being formed by said thermocouple wires which are insulated and rotated to form a coil, each end of said thermocouple wires being connected to a filter capacitor.

22. The system as recited in claim 20 wherein said wellhead comprises a grounding screen positioned adjacent to an outer surface of each wellhead forming a ground plane to eliminate electromagnetic radiation emanating from around said wellhead for operator safety and performance.

23. The system as recited in claim 20 wherein said wellhead comprises a plurality of ground wires extending radially a distance of approximately one wavelength of the electrical energy frequency and spaced apart at predetermined intervals of approximately 15 degrees.

24. The system as recited in. claim 20 wherein said wellhead comprises a grounding screen positioned adjacent to an outer surface of said wellhead forming a ground plane, and a plurality of ground wires extending radially from a perimeter of said grounding screen at a distance of approximately one wavelength of the electrical energy frequency and spaced apart at predetermined intervals.

* * * * *